US011616292B2

(12) United States Patent
Hara

(10) Patent No.: US 11,616,292 B2
(45) Date of Patent: Mar. 28, 2023

(54) ANTENNA, ANTENNA DEVICE, AND ANTENNA DEVICE FOR VEHICLE

(71) Applicant: YOKOWO CO., LTD., Tokyo (JP)

(72) Inventor: Bunpei Hara, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 17/270,478

(22) PCT Filed: Oct. 9, 2019

(86) PCT No.: PCT/JP2019/039775
§ 371 (c)(1),
(2) Date: Feb. 23, 2021

(87) PCT Pub. No.: WO2020/075744
PCT Pub. Date: Apr. 16, 2020

(65) Prior Publication Data

US 2021/0328332 A1 Oct. 21, 2021

(30) Foreign Application Priority Data

Oct. 10, 2018 (JP) ..... JP2018-191581

(51) Int. Cl.
*H01Q 1/32* (2006.01)
*H01Q 5/25* (2015.01)
(Continued)

(52) U.S. Cl.
CPC ..... *H01Q 1/3275* (2013.01); *H01Q 1/36* (2013.01); *H01Q 1/521* (2013.01); *H01Q 5/25* (2015.01); *H01Q 9/40* (2013.01); *H01Q 25/005* (2013.01)

(58) Field of Classification Search
CPC ..... H01Q 1/3275; H01Q 1/36; H01Q 1/521; H01Q 5/25; H01Q 9/30; H01Q 9/32;
(Continued)

(56) References Cited

U.S. PATENT DOCUMENTS 5,872,546 A * 2/1999 Ihara ..... H01Q 9/285 343/795
8,217,850 B1 7/2012 Jennings et al.

FOREIGN PATENT DOCUMENTS

EP 1 249 893 A2 10/2002
JP 2002-43838 A 2/2002
(Continued)

OTHER PUBLICATIONS

Extended European Search Report dated May 11, 2022 in corresponding European Application 19871891.8, 14 pp.
(Continued)

*Primary Examiner* — Robert Karacsony
(74) *Attorney, Agent, or Firm* — Xsensus LLP

(57) ABSTRACT

An antenna (100) includes a ground plate (110) and a radiating element (130) that has a shape expanding in a predetermined expansion direction and a self-similar shape with respect to an end portion (135) connected to a feeding line (151) that is a feeding portion. The radiating element (130) is arranged in a standing state relative to the end portion (135) so as to face the end portion (135) toward the ground plate (110). In addition, the radiating element (130) has a first radiating element portion (131) and a second radiating element portion (133) that are plane-symmetric to each other across a predetermined virtual symmetric plane (A1) along the expansion direction, and thereby forms a shape expanded in the expansion direction.

17 Claims, 16 Drawing Sheets

(51) Int. Cl.

| | |
|---|---|
| ***H01Q 9/40*** | (2006.01) |
| ***H01Q 25/00*** | (2006.01) |
| ***H01Q 1/36*** | (2006.01) |
| ***H01Q 1/52*** | (2006.01) |

(58) Field of Classification Search
CPC .. H01Q 9/38; H01Q 9/40; H01Q 9/42; H01Q 21/28; H01Q 25/005
See application file for complete search history.

(56) References Cited

FOREIGN PATENT DOCUMENTS

| | | | |
|---|---|---|---|
| JP | 2002-164731 | A | 6/2002 |
| JP | 2006-121643 | A | 5/2006 |
| JP | 2008-228165 | A | 9/2008 |

OTHER PUBLICATIONS

Office Action dated Oct. 11, 2022, in corresponding Japanese patent Application No. 2020-551188, 14 pages.

* cited by examiner

ANTENNA, ANTENNA DEVICE, AND ANTENNA DEVICE FOR VEHICLE

CROSS-REFERENCE TO RELATED APPLICATIONS

The present application is based on PCT filing PCT/JP2019/039775, filed Oct. 9, 2019, which claims priority to JP 2018-191581, filed Oct. 10, 2018, the entire contents of each are incorporated herein by reference.

TECHNICAL FIELD

The present invention relates to an antenna, an antenna device, and an antenna device for vehicle.

BACKGROUND ART

As an antenna having broadband characteristics, there is a self-similar antenna having a self-similar shape. For example, a bow-tie antenna that is one of self-similar antennas is known as a broadband antenna that stably operates in a wide frequency band from about 600 MHz to 6 GHz.

Patent Literature 1 discloses an antenna device using the bow-tie antenna.

PRIOR ART DOCUMENTS

Patent Literature

Patent Literature 1: Japanese Unexamined Patent Application Publication No. 2002-43838

SUMMARY OF INVENTION

Problems to be Solved by the Invention

One of characteristics of the bow-tie antenna is non-directionality. Because of this, a bow-tie antenna can be one option at the time when an antenna having non-directionality and broadband characteristics is designed. However, when an antenna that has the broadband characteristics is to be designed while it is required to improve a gain in a desired direction, it is difficult to realize the antenna by simply applying a technology of a conventional self-similar antenna including a conventional bow-tie antenna, as it is.

An object of the invention is to provide a technology for realizing a broadband antenna, which can improve the gain in the desired direction.

Solution to the Problems

According to a first aspect of the present invention, there is provided an antenna comprising:

a radiating element arranged in a standing state relative to an end portion connected to a feeding portion, and having an expanded shape in a predetermined expansion direction, wherein the radiating element has a first radiating element portion and a second radiating element portion being plane-symmetric to each other across a predetermined virtual symmetric plane along the expansion direction, thereby forms the expanded shape, and has a self-similar shape with respect to the end portion.

According to the first aspect, the antenna can be structured such that the shape of the radiating element is a shape that expands in the predetermined expansion direction and is the self-similar shape with respect to the end portion that is connected to the feeding portion, and the radiating element is arranged in a standing state relative to the end portion. The antenna of the present aspect can increase the gain in the expansion direction. Accordingly, a broadband antenna can be realized that can control the directionality of the antenna by the orientation of the expansion direction, and improves the gain in the desired direction.

According to a second aspect of the present invention, in the antenna according to the first aspect, an opening degree of the expansion formed by the first radiating element portion and the second radiating element portion is 20 degrees or larger and 160 degrees or smaller.

According to the second aspect, the opening degree of the radiating element in the expansion direction according to the expanded shape can be controlled to 20 degrees or larger and 160 degrees or smaller.

According to a third aspect of the present invention, in the antenna according to the first or second aspect, the first radiating element portion and the second radiating element portion are integrally structured via a predetermined folded portion located on the virtual symmetric plane.

According to the third aspect, the antenna can be formed into a structure in which the first radiating element portion and the second radiating element portion that are integrally structured are folded at the folded portion, and the radiating element can be expanded at a predetermined opening degree.

According to a fourth aspect of the present invention, in the antenna according to the third aspect, the expanded shape is a V shape folded at the folded portion, when the first radiating element portion and the second radiating element portion are viewed from above.

According to the fourth aspect, the expanded shape can be the V shape that is folded at the folded portion when the first radiating element portion and the second radiating element portion are viewed from above.

According to a fifth aspect of the present invention, in the antenna according to the third or fourth aspect, the folded portion has a linear folding line, and a length of the radiating element in a direction of the folding line in a projection view onto the virtual symmetric plane is a length of ⅛ or longer of a wavelength of a radio wave at a lower limit of antenna band frequencies.

According to the fifth aspect, it is possible to set the length in the direction along the folding line of the radiating element in the projection view of the radiating element onto the virtual symmetric plane, at ⅛ or longer of the wavelength.

According to a sixth aspect of the present invention, in the antenna according to the first or second aspect, the first radiating element portion and the second radiating element portion are integrally structured without a part of a predetermined virtual folded portion located on the virtual symmetric plane.

According to the sixth aspect, the first radiating element portion and the second radiating element portion can be integrally structured so as to be folded without including a part of the virtual folded portion, and accordingly, the radiating element can be expanded at a predetermined opening degree.

According to a seventh aspect of the present invention, in the antenna according to the sixth aspect, the expanded shape is a V shape starting from the end portion as a base point, when the first radiating element portion and the second radiating element portion are viewed from above and are projected toward the end portion side.

According to the seventh aspect, the expanded shape can be set at a V shape starting from the end portion as the base point, when the first radiating element portion and the second radiating element portion are viewed from above.

According to an eighth aspect of the invention, in the antenna according to the sixth or seventh aspect, the virtual folded portion has a virtual linear folding line, and a length of the radiating element in a direction of the virtual folding line in a projection view onto the virtual symmetric plane is a length of ⅛ or longer of a wavelength of a radio wave at a lower limit of antenna band frequencies.

According to the eighth aspect, it is possible to set the length in the direction along the virtual folding line of the radiating element in the projection view of the radiating element onto the virtual symmetric plane, at ⅛ or longer of the wavelength.

According to a ninth aspect of the invention, in the antenna according to the fifth or eighth aspect, the lower limit of the antenna band frequencies is 1 GHz or higher.

According to the ninth aspect, the antenna band frequency can be set at 1 GHz or higher.

According to a tenth aspect of the present invention, there is provided an antenna device comprising a plurality of antennas according to any one of the first to ninth aspects.

According to the tenth aspect, it is possible to realize an antenna device including a plurality of antennas according to any one of the first to ninth aspects.

According to an eleventh aspect of the present invention, there is provided an antenna device comprising a plurality of antennas according to any one of the first to ninth aspects, so as to face the expansion directions of the antennas toward different directions from each other.

According to the eleventh aspect, the antenna device can be structured in which the plurality of antennas according to any one of the first to ninth aspects are arranged such that the expansion directions thereof are faced toward different directions. Accordingly, each antenna can increase a gain of its expansion direction, and accordingly, for example, by adjusting the number of antennas or individual expansion directions so that the antennas cover all azimuth directions on a predetermined plane, it becomes possible to realize an antenna device having characteristics of high gain and non-directionality in a broad band.

According to a twelfth aspect of the present invention, there is provided an antenna device for vehicle comprising: the antenna according to any one of the first to ninth aspects; another antenna for radio receiving having an antenna band frequency lower than that of the antenna; and a case for accommodating the antenna and the other antenna.

According to the twelfth aspect, it is possible to realize the antenna device for vehicle that accommodates an antenna having a similar effect to that of any one of the first to ninth aspects, and another antenna for radio receiving, of which the antenna band frequency is lower than that of the antenna, in the case.

According to a thirteenth aspect of the present invention, there is provided an antenna comprising:

a radiating element arranged in a standing state relative to an end portion connected to a feeding portion, and having an expanded shape in a predetermined expansion direction, wherein the radiating element has a first radiating element portion and a second radiating element portion being plane-symmetric to each other across a predetermined virtual symmetric plane along the expansion direction, and thereby forms the expanded shape; and wherein an angle formed by the end portion and the first radiating element portion is an acute angle, and an angle formed by the end portion and the second radiating element portion is an acute angle.

According to the thirteenth aspect, an antenna can be structured such that the shape of the radiating element is a shape expanding in a predetermined expansion direction, an angle formed by the end portion and the first radiating element portion is set at an acute angle, an angle formed by the end portion and the second radiating element portion is set at an acute angle, and the radiating element is arranged in a standing state relative to the end portion. The antenna of the present aspect can increase the gain in the expansion direction. Accordingly, the antenna can control its directionality by the orientation of the expansion direction, and it becomes possible to realize a broadband antenna that improves a gain in a desired direction.

DESCRIPTION OF EMBODIMENTS

Figure 1:
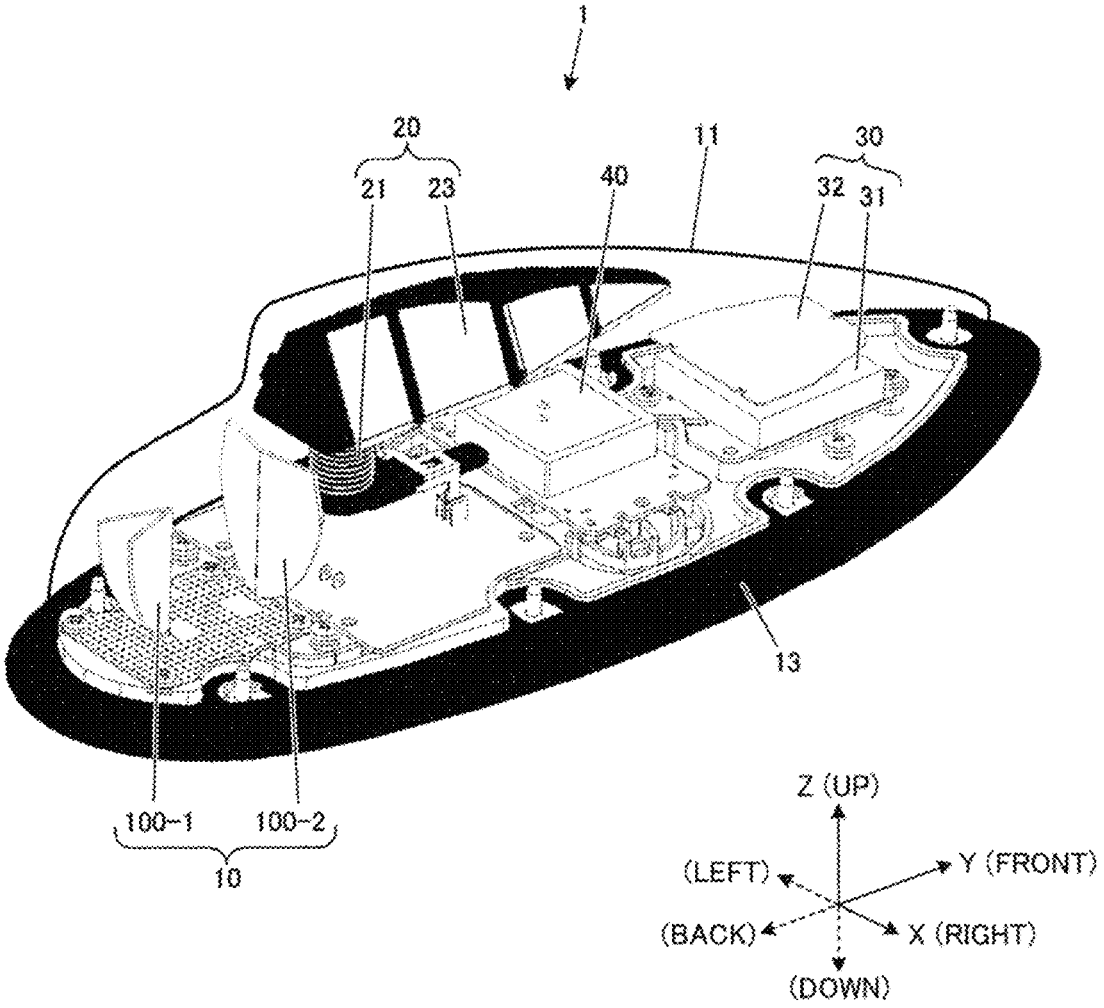
FIG. 1 is a view illustrating an example of an internal structure of an antenna device for vehicle.

One example of preferred embodiments of the invention will be described below with reference to the drawings. Note that the invention is not limited by the embodiments that will be described below, and modes to which the invention can be applied are not also limited by the following embodiments. In addition, in the description of the drawings, the same portion is denoted by the same reference numeral.

Firstly, in the present embodiment, the direction is defined in the following way. Specifically, the antenna device for vehicle 1 of the present embodiment is used by being mounted on vehicles such as passenger automobiles, and the directions of front-rear, left-right and up-down of the device are defined to be the same as the directions of front-rear, left-right and up-down of vehicles at the time when the device is mounted on the vehicles. In addition, the front-rear direction is defined as a Y-axis direction, the left-right direction is defined as an X-axis direction, and the up-down direction is defined as a Z-axis direction. Reference directions that indicate directions parallel to the respective axial directions are added to the respective figures so that the directions of the three orthogonal axes can be easily understood. The intersection of the reference directions illustrated in each figure does not mean the coordinate origin. The added coordinate illustrates only reference directions. In addition, an appearance of the antenna device for vehicle 1 of the present embodiment is designed such that the front is tapered off and the width between right and left sides gradually decreases toward the upper side from the face attached on the vehicle, which can accordingly facilitate understanding the direction for the feature of the design.

FIG. 1 is a perspective view illustrating an example of an internal structure of an antenna device for vehicle 1 according to the present embodiment. As is illustrated in FIG. 1, the antenna device for vehicle 1 is structured so as to accommodate a plurality of types of antennas in a space that is formed by an antenna case 11 that is a case and an antenna base 13. The space accommodates, for example, an antenna device 10 including two antennas 100 (100-1 and 100-2) that can be used as antennas for wireless communication or the like, a radio antenna 20, a satellite radio antenna 30, and a GNSS (Global Navigation Satellite system) antenna 40.

More specifically, the antenna case 11 has a shape protruding upward at the central portion. In other words, the antenna case 11 has a shark fin shape. Then, the protruding portion above the internal space has a capacitance loading element 23 of the radio antenna 20 arranged in its inside, and has a helical element 21 arranged below the capacitance loading element 23. In addition, the internal space has two antennas 100-1 and 100-2 of the antenna device 10 arranged in a rear side of the bottom, and the internal space has the satellite radio antenna 30 and the GNSS antenna 40 arranged in a front side of the bottom. Length of the antennas 100-1 and 100-2 from the antenna base 13 to the highest position toward the upside, which are the overall height of the antennas 100-1 and 100-2 that are arranged in the antenna device for vehicle 1, are each lower than the overall height of the radio antenna 20. It can also be said that the antennas 100-1 and 100-2 are arranged at positions lower than the radio antenna 20. In addition, the antennas 100-1 and 100-2 are arranged at positions behind the radio antenna 20.

The radio antenna 20 is, for example, a radio receiving antenna for receiving broadcast waves of AM radio broadcasting and FM radio broadcasting. The radio antenna 20 includes a helical element 21 in which a conductor is spirally wound and a capacitance loading element 23 for adding a ground capacitance to the helical element 21, resonates with an FM wave band by the capacitance loading element 23 and the helical element 21, and receives an AM wave band by the capacitance loading element 23. The antenna band frequencies of the radio antenna 20 are lower than the antenna band frequencies of the antenna device 10. Accordingly, it can be said that interference is unlikely to occur between the antenna 100 and the radio antenna 20 (another antenna from the antenna 100), in view of the arrangement position and the frequency band as well.

The satellite radio antenna 30 is an antenna for receiving broadcast waves of satellite radio broadcasting such as Sirius (Sirius) XM radio. For example, as is illustrated in FIG. 1, a planar antenna 31 such as a patch antenna can be used as the satellite radio antenna 30. In addition, as illustrated in FIG. 1, the satellite radio antenna 30 can be structured such that a parasitic element 32 is arranged together with the planar antenna 31. Note that the type of antenna is not limited thereto and may be selected as appropriate.

The GNSS antenna 40 is an antenna for receiving satellite signals that are transmitted from a satellite for positioning such as a GPS satellite.

Figure 2:
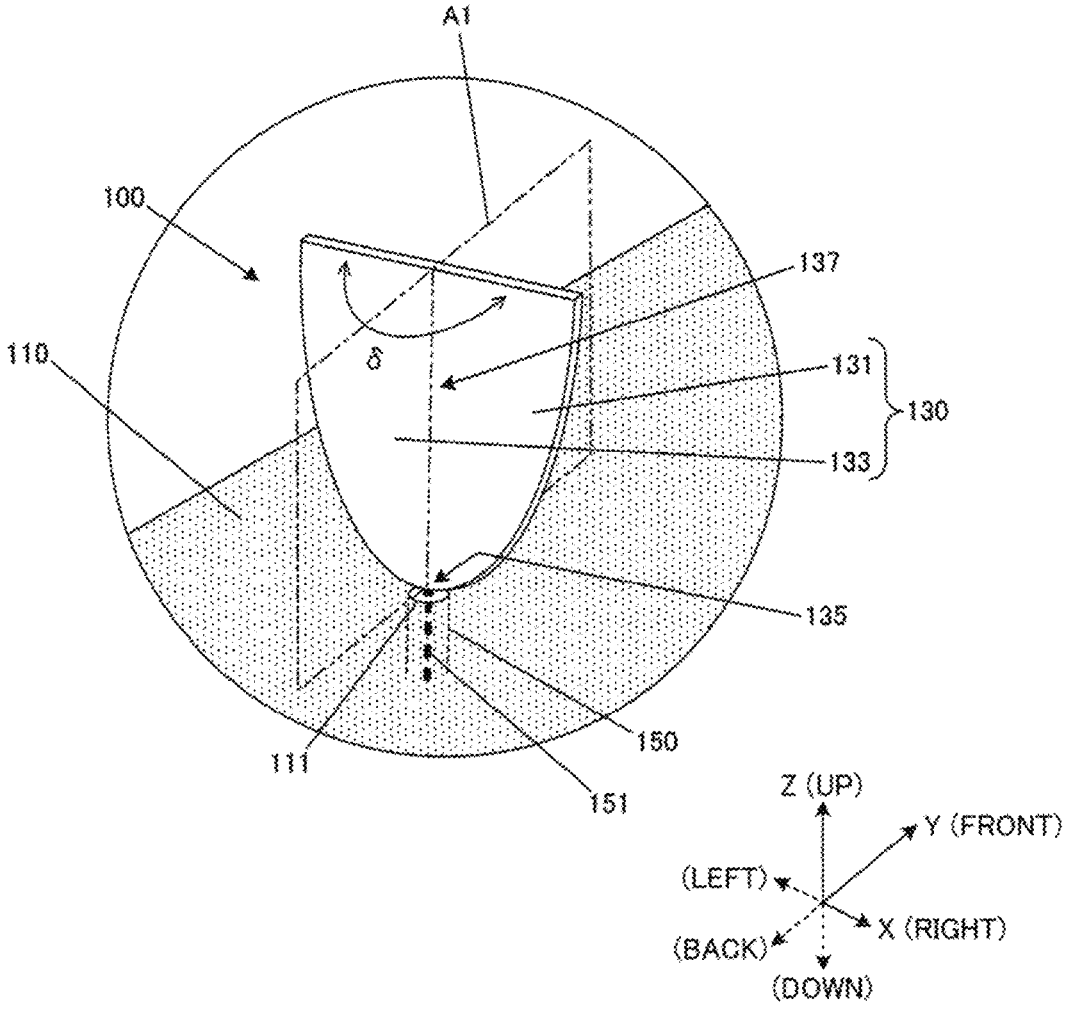
FIG. 2 is a view illustrating a structure example of one of antennas in an antenna device.

Next, the antenna 100 will be described. FIG. 2 is an enlarged view illustrating a structure example of one antenna 100 (for example, the antenna 100-1 on the rear side) in the antenna device 10. As will be described in detail later, the antenna 100 of the present embodiment has a shape in which the radiating element 130 expands in a predetermined expansion direction (in the example of FIG. 2, the backward orientation that is a negative direction of the Y-axis), but FIG. 2 illustrates a completely expanded state (a state where the opening degree of expansion is $\delta=180$ degrees).

As is illustrated in FIG. 2, the antenna 100 includes a ground plate 110 and a radiating element 130 that is arranged in a standing state relative to the ground plate 110 so that an end portion 135 faces the ground plate 110, in other words, in a standing state relative to the end portion 135.

The ground plate 110 has an insertion hole 111 that penetrates vertically (in the Z-axis direction). The feeding line is inserted through the insertion hole 111. The end portion 135 of the radiating element 130 that is directed toward the ground plate 110 is connected to the feeding line 150 that serves as a feeding portion, at a position directly above the insertion hole 111. When the feeding line 150 is formed of a coaxial cable, the inner conductor 151 of the coaxial cable is connected to the end portion 135, and the outer conductor is connected to the ground plate 110.

The radiating element 130 has a self-similar shape with respect to the end portion 135. When the opening degree $\delta$ is 180 degrees as is illustrated in FIG. 2, the radiating element 130 has a semi-elliptic plate shape, and is arranged such that the plate surface is perpendicular to the ground plate 110 and the expansion direction is the backward orientation (Y-axis negative direction). It can also be said that the plate surface is arranged parallel to the XZ plane. In FIG. 2, the center line in the left-right direction of the radiating element 130 is indicated by an alternate long and short dash line.

Figure 3:
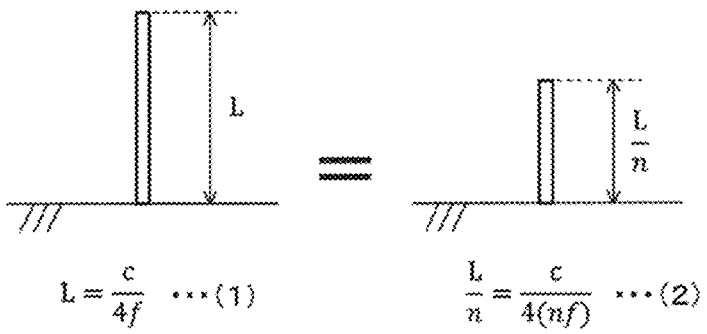
FIG. 3 is an explanatory diagram for explaining fundamental characteristics of an antenna.

Here, fundamental characteristics of the antenna 100, particularly characteristics originating in the self-similar shape will be described. For ease of understanding, a bow-tie antenna that is well known as an antenna having the self-similar shape will be described as an example. First of all, as a premise, when the antenna size and the frequency keep an inversely proportional relationship, the electrical characteristics of the antenna show the same characteristics in principle even if the antenna size or the frequency changes. For example, when the current distribution in a monopole antenna behaves in a resonating way, the antenna size (height) L and the frequency f can be expressed by the relational expression (1) illustrated in FIG. 3. In addition, in general, a behavior of the frequency fat a certain antenna size L is the same as the behavior of the frequency of at L/n of 1/n of the antenna size, which is illustrated in the relational expression (2).

Figure 4:
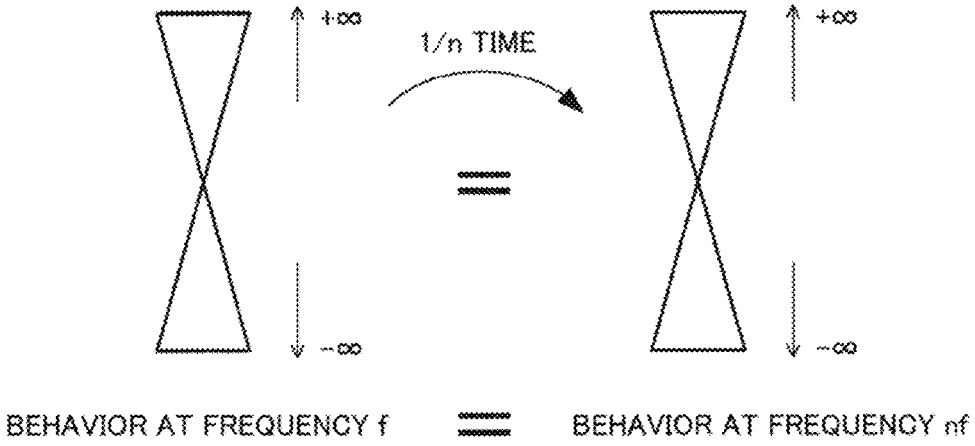
FIG. 4 is another explanatory diagram for explaining the fundamental characteristics of an antenna.

Subsequently, as is illustrated in FIG. 4, a structure shall be considered in which two radiating elements each of which has a shape of an isosceles triangle and an infinite height are arranged so as to face each other so that the apexes butt against each other. The antenna of this structure is the bow-tie antenna. In such a structure, even though the scale (size) is changed to any scale (1/n times in the example of FIG. 4), the shapes before and after the change are the same and have the self-similar relationship. Accordingly, even though the frequency increases to any multiple, the antenna size is the same, and both show the same electrical characteristics. In particular, the output impedance shows a substantially constant value at any frequency, and accordingly, it becomes an important characteristic in a broadband antenna that both show the same electrical characteristics.

Figure 5:
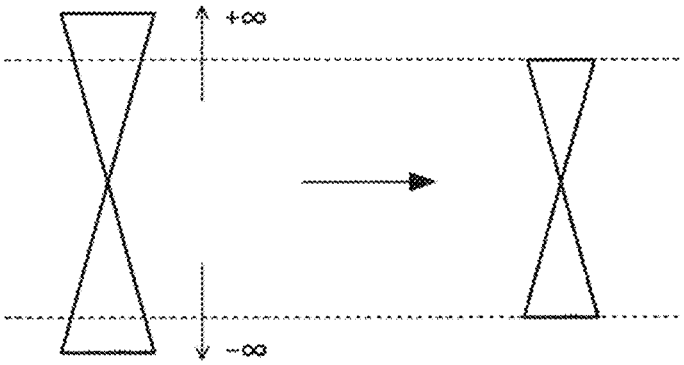
FIG. 5 is another explanatory diagram for explaining the fundamental characteristics of an antenna.

The antenna size that can be actually produced is limited, and accordingly, a limited range of the self-similar shape results in being cut out and used. For example, as is illustrated by a broken line in FIG. 5, if an antenna is cut out at a position that has a predetermined length from the apex, with respect to the butted apex as a reference, the cut-out antenna shows a constant characteristic independent of frequency, only at a predetermined frequency or higher, which is determined by the cut-out length from the apex. The lower limit of the frequencies indicating the characteristics has an inversely proportional relationship with the antenna size.

In addition, in actual design, there is a case where the shape of the radiating element is deformed from the isosceles triangle, for adjustment of impedance, or the like. For example, the isosceles triangle shape can be changed to a semi-elliptical shape such as the radiating element 130 of the antenna 100 of the present embodiment. In this case as well, it is possible to utilize the constant electrical characteristics that are obtained by the self-similar shape.

The antenna 100 according to the present embodiment includes a ground plate 110 and one radiating element 130 having a self-similar shape, in place of two radiating elements that are arranged so as to face each other so that the apexes butt against each other as in a bow-tie antenna. Then, the antenna 100 is structured by arranging the radiating element 130 in such a state that the end portion 135 that serves as a reference of the self-similar shape stands toward the ground plate 110. Due to this structure, the antenna 100 of the present embodiment can spuriously obtain an operational effect substantially similar to that of a bow-tie antenna. Although the radiating element 130 is one, such an operational effect as if another radiating element is virtually arranged on the opposite side is obtained due to the ground plate 110.

The description shall return to FIG. 2. As described above, the radiating element 130 having a self-similar shape (for example, a semi-elliptical shape) forms an expanded shape of the radiating element 130, by the first radiating element portion 131 and the second radiating element portion 133 that are plane-symmetric to each other across the predetermined virtual symmetric plane (in the example of FIG. 2, a plane parallel to the YZ plane) A1 along the expansion direction (in the example of FIG. 2, the backward orientation that is the Y-axis negative direction). In the present embodiment, the first radiating element portion 131 and the second radiating element portion 133 are integrally structured via a folded portion 137, where the folded portion 137 is a portion of a linear shape along the center line on the virtual symmetric plane A1. It should be noted that in the radiating element 130, an angle formed by the end portion 135 and the first radiating element portion 131 is an acute angle, and an angle formed by the end portion 135 and the second radiating element portion 133 is an acute angle. The end portion 135 is arranged on the ground plate 110. Because of this, the angle formed by the end portion 135 and the first radiating element portion 131 corresponds to an angle formed by the outer portion of the first radiating element portion 131, which extends from the end portion 135, and the ground plate 110. Similarly, the angle formed by the end portion 135 and the second radiating element portion 133 corresponds to an angle formed by the outer portion of the second radiating element portion 133, which extends from the end portion 135, and the ground plate 110. It should be noted that the angle formed by the end portion 135 and the first radiating element portion 131 is substantially the same as the angle formed by the end portion 135 and the second radiating element portion 133.

Figure 6:
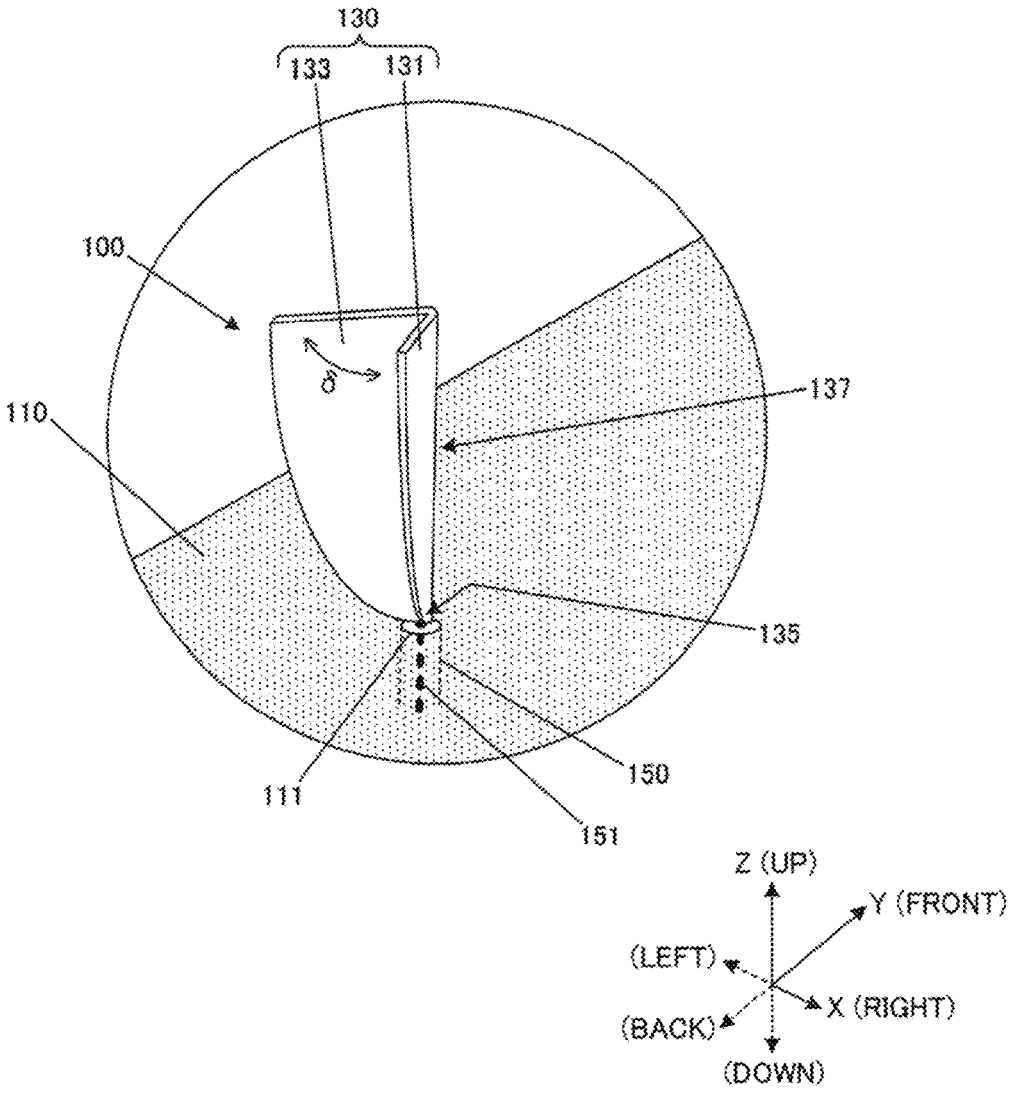
FIG. 6 is another view illustrating a structure example of an antenna in an antenna device.

Then, in the radiating element 130, an opening degree δ of expansion of the radiating element 130 (an angle formed by the first radiating element portion 131 and the second radiating element portion 133) is set by a folding angle of the folded portion 137. FIG. 6 illustrates the antenna 100 in which the opening degree δ is set at 60 degrees. The characteristics of the antenna 100 can be changed by the opening degree δ being changed.

Figure 7:
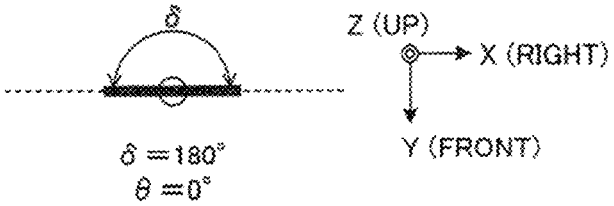
FIG. 7 is a top view of an antenna in a case where an opening degree has been set at δ=180 degrees.
Figure 8:
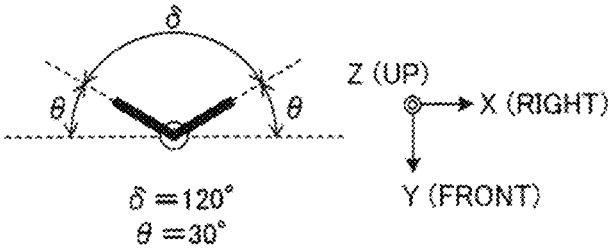
FIG. 8 is a top view of an antenna in a case where an opening degree has been set at δ=120 degrees.
Figure 9:
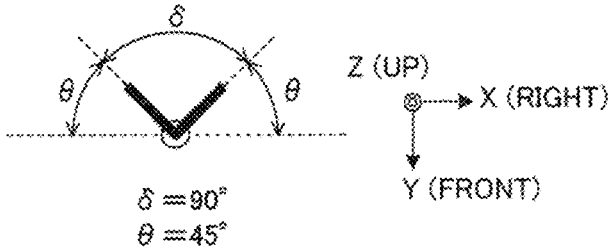
FIG. 9 is a top view of an antenna in a case where an opening degree has been set at δ=90 degrees.
Figure 10:
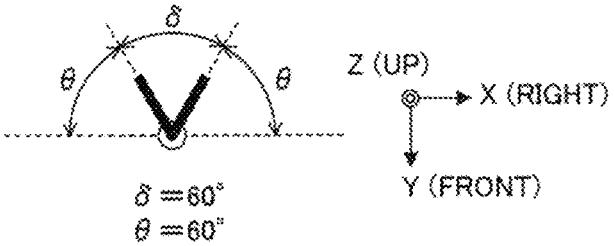
FIG. 10 is a top view of an antenna in a case where an opening degree has been set at δ=60 degrees.
Figure 11:
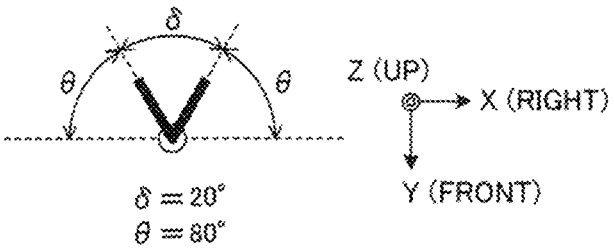
FIG. 11 is a top view of an antenna in a case where an opening degree has been set at δ=20 degrees.
Figure 12:
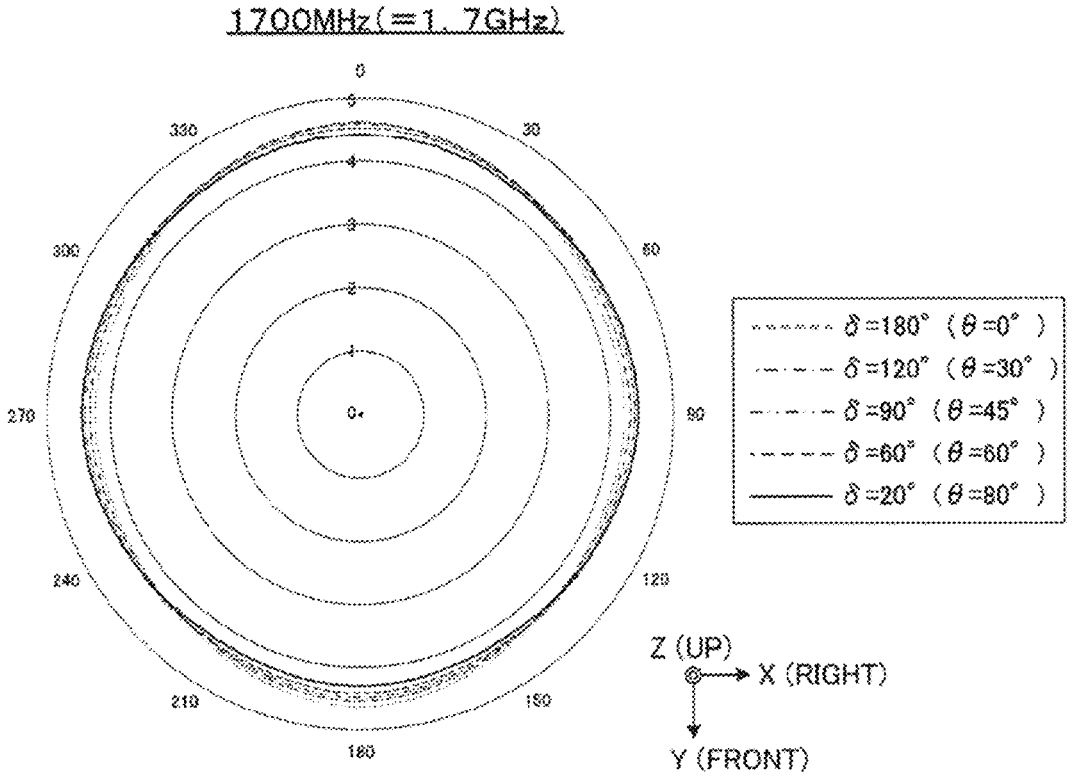
FIG. 12 is a view illustrating a directionality pattern at the time when the usable frequency is 1700 MHz.
Figure 13:
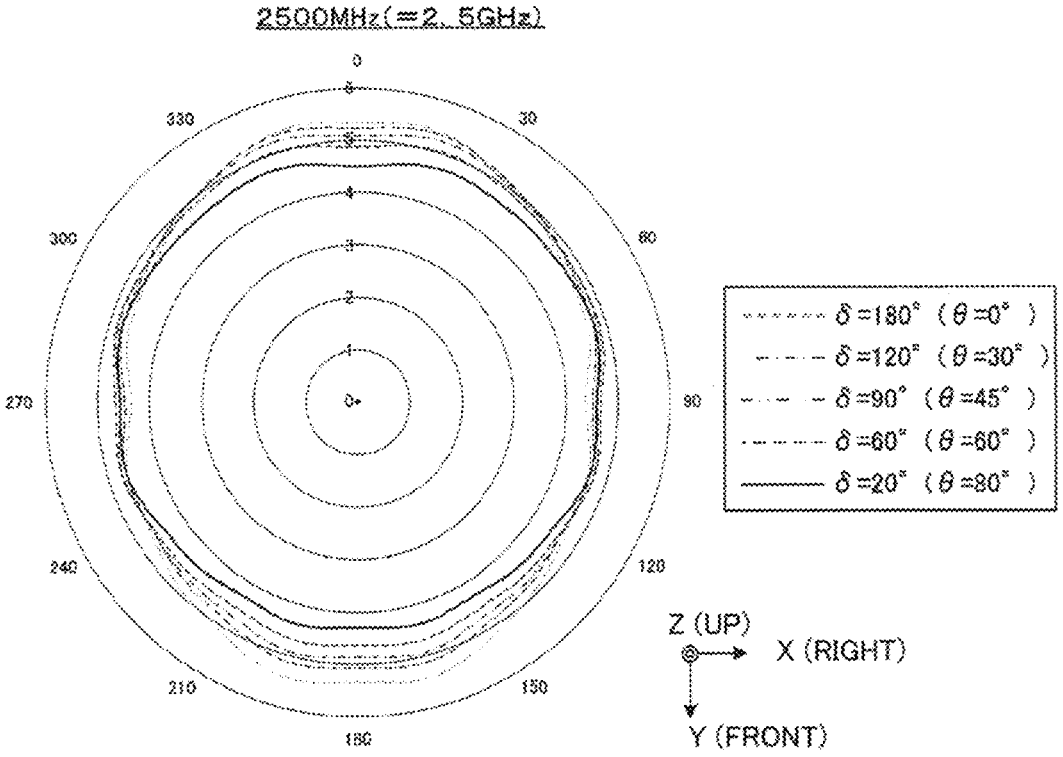
FIG. 13 is a view illustrating a directionality pattern at the time when the usable frequency is 2500 MHz.
Figure 14:
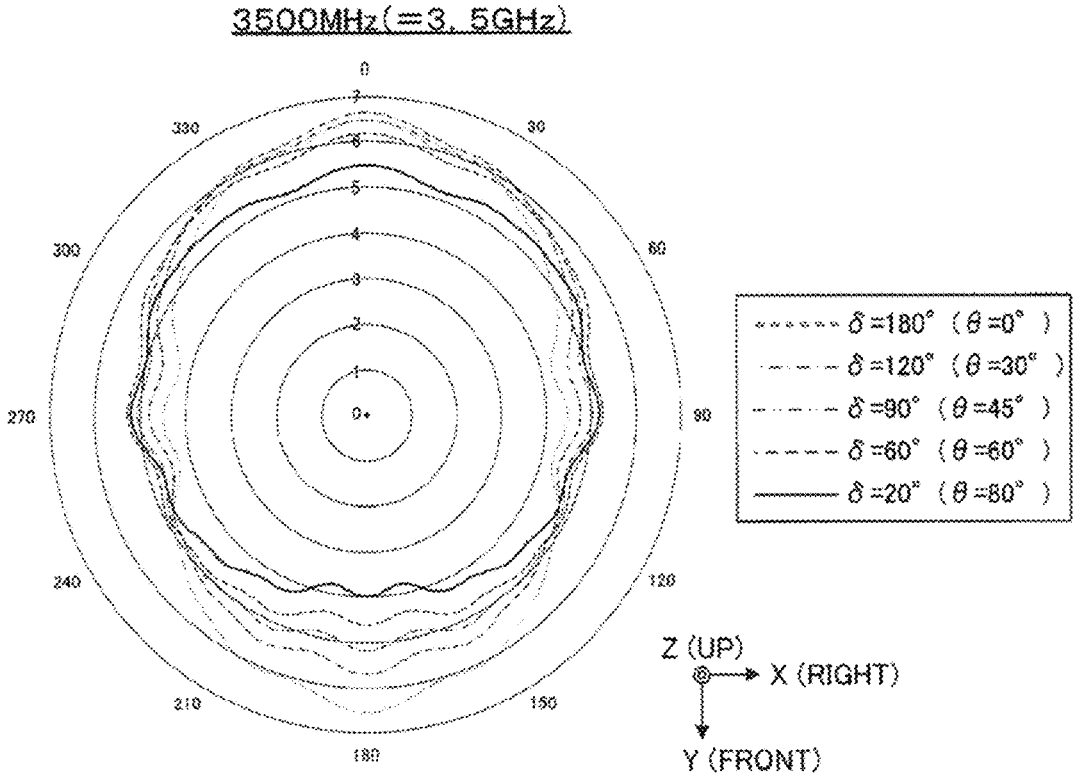
FIG. 14 is a view illustrating a directionality pattern at the time when the usable frequency is 3500 MHz.
Figure 15:
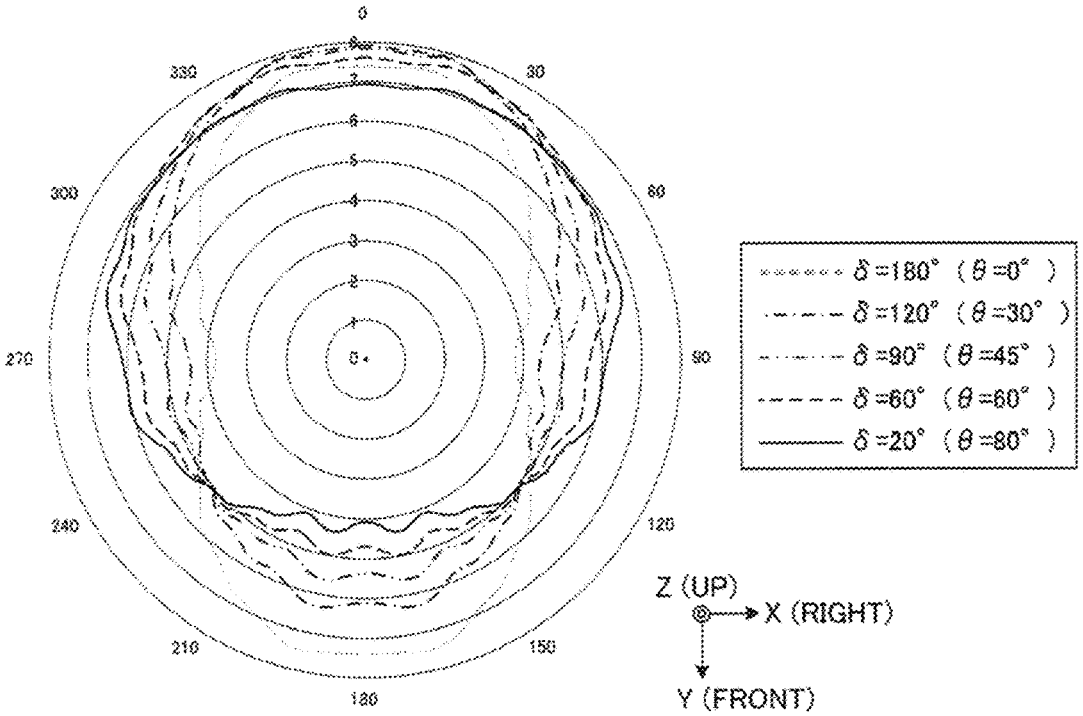
FIG. 15 is a view illustrating a directionality pattern at the time when the usable frequency is 4500 MHz.
Figure 16:
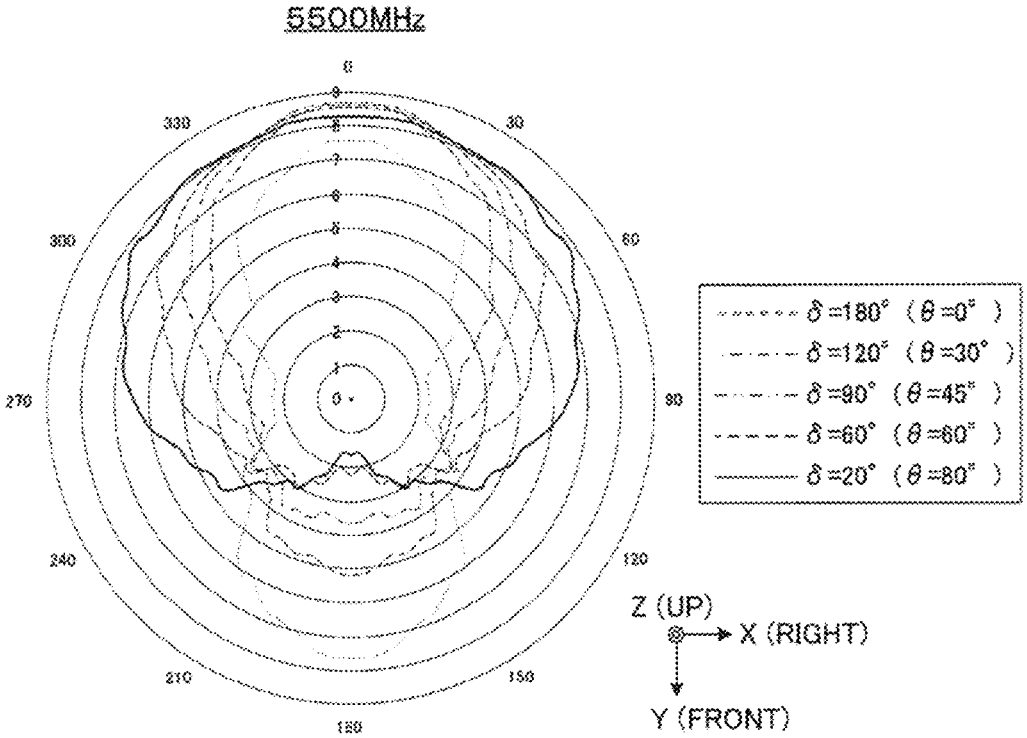
FIG. 16 is a view illustrating a directionality pattern at the time when the usable frequency is 5500 MHz.
Figure 17:
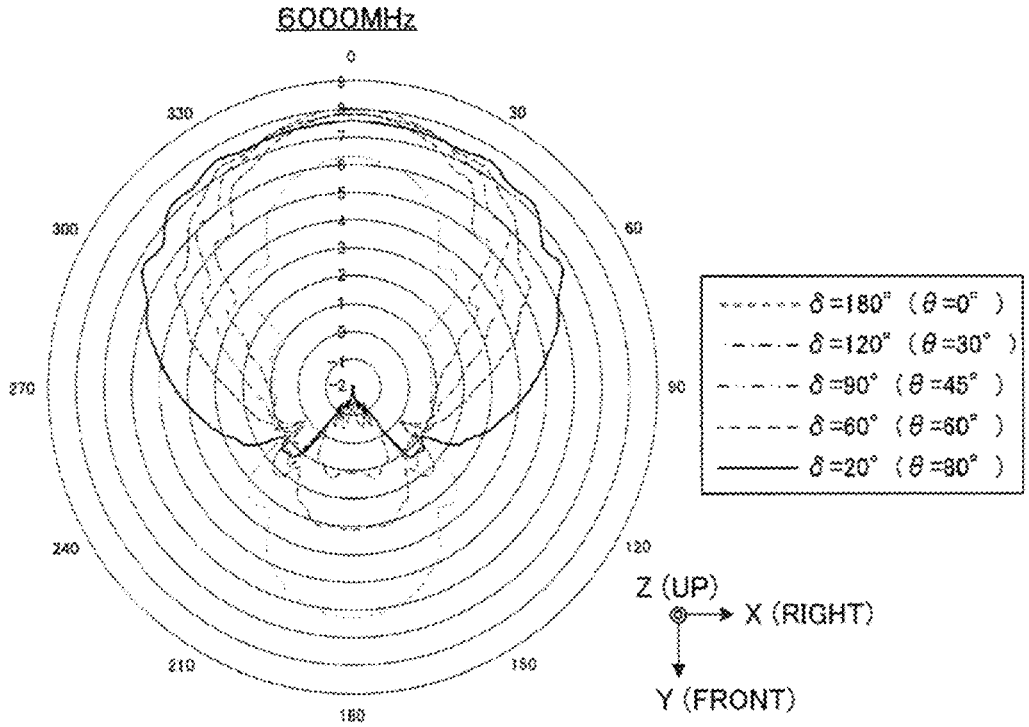
FIG. 17 is a view illustrating a directionality pattern at the time when the usable frequency is 6000 MHz.

FIG. 7 is a top view of the antenna 100 at the time when the opening degree δ that is an angle formed by the first radiating element portion 131 and the second radiating element portion 133 is set at 180 degrees. In addition, a displacement angle of each of the first radiating element portion 131 and the second radiating element portion 133 is also illustrated as a folding angle θ, at the time when the first radiating element portion 131 and the second radiating element portion 133 have been folded at the folded portion 137 from a state where the first radiating element portion 131 and the second radiating element portion 133 are arranged on the same plane. In the case of FIG. 7, the folding angle θ becomes 0 degree. The angle can be converted by $\delta=180-\theta\times2$. In addition, top views of the antenna 100 are each illustrated in FIG. 8 in which δ is 120 degrees (θ is 30 degrees), in FIG. 9 in which δ is 90 degrees (θ is 45 degrees), in FIG. 10 in which δ is 60 degrees (θ is 60 degrees), and in FIG. 11 in which δ is 20 degrees (θ is 80 degrees). As can be understood from FIG. 8 to FIG. 11, the expanded shape of the first radiating element portion 131 and the second radiating element portion 133 is a V shape (chevron shape) in which the first radiating element portion 131 and the second radiating element portion 133 are folded at the folded portion 137, in the top view. In addition, FIG. 12 to FIG. 17 are views illustrating the directionality patterns of the horizontal plane (XY plane), which have been acquired at the folding angles θ of FIG. 7 to FIG. 11, at different frequencies. Specifically, FIG. 12 illustrates a directionality pattern at the time when the usable frequency is set at 1700 MHz, FIG. 13 illustrates the directionality pattern at the time when the usable frequency is set at 2500 MHZ, FIG. 14 illustrates the directionality pattern at the time when the usable frequency is set at 3500 MHz, FIG. 15 illustrates the directionality pattern at the time when the usable frequency is set at 4500 MHz, FIG. 16 illustrates the directionality pattern at the time when the usable frequency is set at 5500 MHz, and FIG. 17 illustrates the directionality pattern at the time when the usable frequency is set at 6000 MHz, respectively.

For example, as is illustrated in FIG. 12, in a case where a usable frequency is 1700 MHz (=1.7 GHz), there is not a significant difference in the directionality of each azimuth direction, and even when the opening degree δ is changed from 180 degrees to 20 degrees (even when the folding angle θ is changed from 0 degrees to 80 degrees), there is not a significant difference in the directionality in the case of 1700 MHz. On the other hand, when the frequency is increased as are illustrated in FIG. 13 to FIG. 17, a difference appears in the directionality for each opening degree δ (folding angle θ). For example, in the 6000 MHz (=6.0 GHz) illustrated in FIG. 17, a difference in the directionality according to the opening degree δ (folding angle θ) remarkably appears.

Specifically, when the opening degree δ is 180 degrees (when the folding angle θ is 0 degree) in 6.0 GHz, both gains in the azimuth direction of the Y-axis positive direction (the forward direction, a direction at which the azimuth angle is 180 degrees) and of the Y-axis negative direction (the backward direction, a direction at which the azimuth angle is 0 degree) appear equally high compared to those in the direction in the X-axis (the left-right direction); and show the directionality of a limited azimuth angle range of about 60 degrees (in total of an azimuth angle of 0 degree to an azimuth angle of 30 degrees and an azimuth angle of 330 degrees to an azimuth angle of 360 degrees, in the case of the backward direction) as the azimuth angle range, in each of the forward direction and the backward direction. On the other hand, when the opening degree δ is set to be smaller than 180 degrees (the folding angle θ is set to be larger than 0 degree), a higher gain than the gain at the time when the opening degree δ is 180 degrees (when the folding angle θ is 0 degree) appears in the azimuth direction of the backward direction (Y-axis negative direction) that is the expansion direction. In addition, as the opening degree δ is decreased (as the folding angle θ is increased), an azimuth angle range in which a high gain appears gradually expands from the azimuth direction in the backward direction (Y-axis negative direction) that is the expansion direction, to the azimuth direction close to the left-right direction. On the other hand, the gain in the forward direction (Y-axis positive direction) opposite to the expansion direction decreases as the opening degree δ is decreased (as the folding angle θ is increased). As described above, the antenna 100 of the present embodiment shows such operational effects that as the frequency is increased, the directionality in the expansion direction appears and the difference in the directionality according to the opening degree δ is exhibited, and that as the opening degree δ is decreased (the folding angle θ is increased), the azimuth angle range in which a high gain is obtained gradually expands around the azimuth direction of the expansion direction.

In a case where the antenna band frequencies of the antenna 100 include 5 to 6 GHz, a high gain is obtained on the expansion direction side when the opening degree δ is set in a range of one degree or more and 179 degrees or smaller, but it can be said that preferably by setting the opening degree δ in a range of 20 degrees or larger and 160 degrees or smaller, an azimuth angle range in which a high gain can be obtained can be obtained on the expansion direction side including the azimuth direction of the expansion direction. At this time, when the lower limit of the antenna band frequencies is determined to be 1 GHz, even in a case where the usable frequency is 1 GHz, the gains become a high state in all azimuth directions as is estimated from FIG. 12, and accordingly the gain on the expansion direction side is also kept high. Accordingly, it can be said to be a practical broadband antenna characteristic to structure the antenna 100 so that the opening degree δ is in a range of 20 degrees or larger and 160 degrees or smaller and to set the lower limit of the antenna band frequencies to 1 GHz or higher, in view of frequency bands of mobile communication standard in the present and future days.

However, in the case where the antenna 100 singly uses frequencies exceeding 4 GHz, a high gain can be obtained in the expansion direction by setting the opening degree δ in a range of 20 degrees or larger and 160 degrees or smaller, but, for example, the gain in the direction opposite to the expansion direction becomes low. For this reason, it is possible to realize a broadband antenna that has a high gain as a whole and is non-directional or nearly non-directional, by arranging a plurality of antennas so that the expansion directions are faced toward different orientations, on the basis of the characteristics exhibited by a single antenna 100. For example, in addition to the antenna 100 illustrated in FIG. 6 and the like, another antenna 100 is arranged back-to-back so that the expansion directions become reverse (so that the expansion direction of the radiating element 130 is faced toward the Y-axis positive direction). The structure of the antenna device 10 in FIG. 1 is one example of this structure. Thereby, it is possible to realize an antenna device 10 that is non-directional or nearly non-directional as the whole of the antenna device including the two antennas 100.

Figure 18:
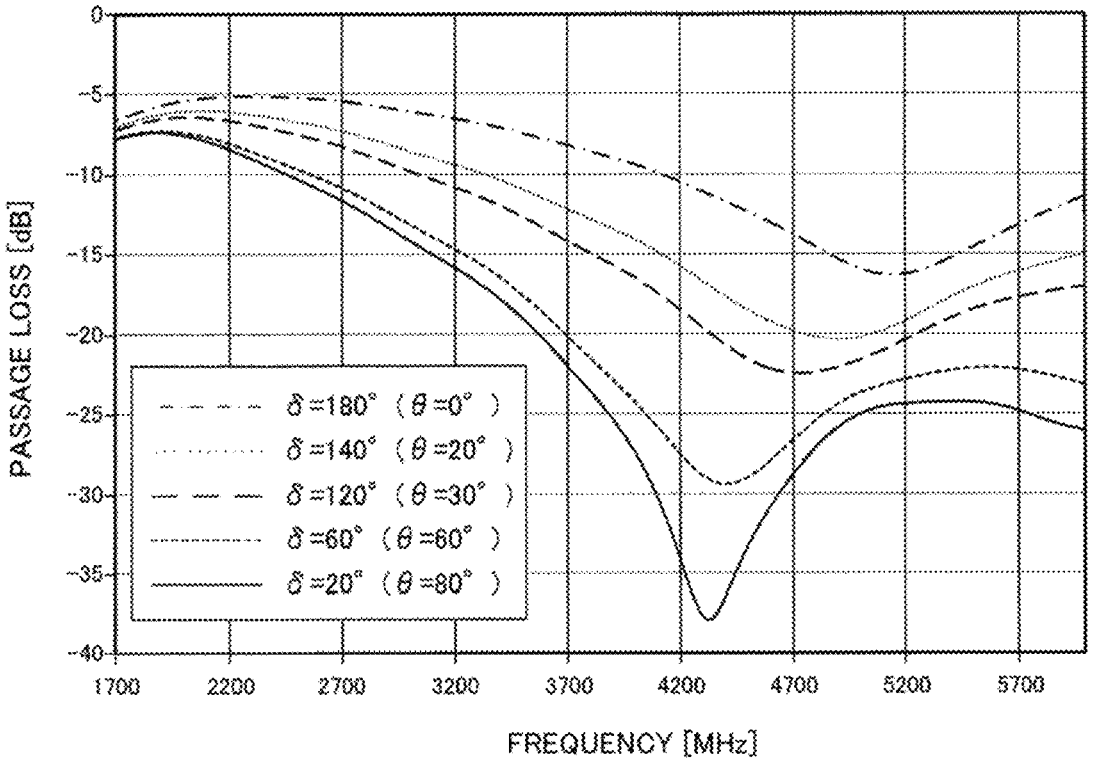
FIG. 18 is a graph illustrating passage loss characteristics between two antennas.

FIG. 18 is a view illustrating loss characteristics at the time when an electric power passes from a feeding point of one antenna 100 to a feeding point of the other antenna 100, in a case where one antenna device is structured of two antennas 100 that are arranged such that the expansion directions are reverse to each other. FIG. 18 illustrates values of the passage loss at the time when the opening degrees δ of radiating elements 130 are set at 180 degrees, 140 degrees, 120 degrees, 60 degrees and 20 degrees (0 degree, 20 degrees, 30 degrees, 60 degrees and 80 degrees in terms of the folding angle θ), respectively. As is illustrated in FIG. 18, the smaller is the opening degree δ (the larger the folding angle θ), the lower is the value of the passage loss in the case where a plurality of antennas 100 are arranged, and it becomes possible to enhance the isolation between the antennas 100 in a wide frequency range.

As described with reference to FIG. 12 to FIG. 17, even though the opening degree δ is the same, the azimuth angle range in which high gains are obtained becomes narrower in 6.0 GHz than in 1.7 GHz. In addition, by reducing the opening degree δ, it becomes possible to widen the azimuth angle range in which a high gain is obtained around the expansion direction. The reduction of the opening degree δ also leads to the enhancement of the isolation as is illustrated in FIG. 18. However, as the opening degree δ is decreased, the gain in the azimuth direction of the expansion direction (Y-axis negative direction) gradually decreases. For this reason, in the case where the antenna device is structured of a plurality of antennas 100, it becomes possible to optimize the balance among the gain, the range of the directionality, and the isolation, by appropriately selecting the opening degree δ (folding angle θ) of each antenna 100 to be used.

Figure 19:
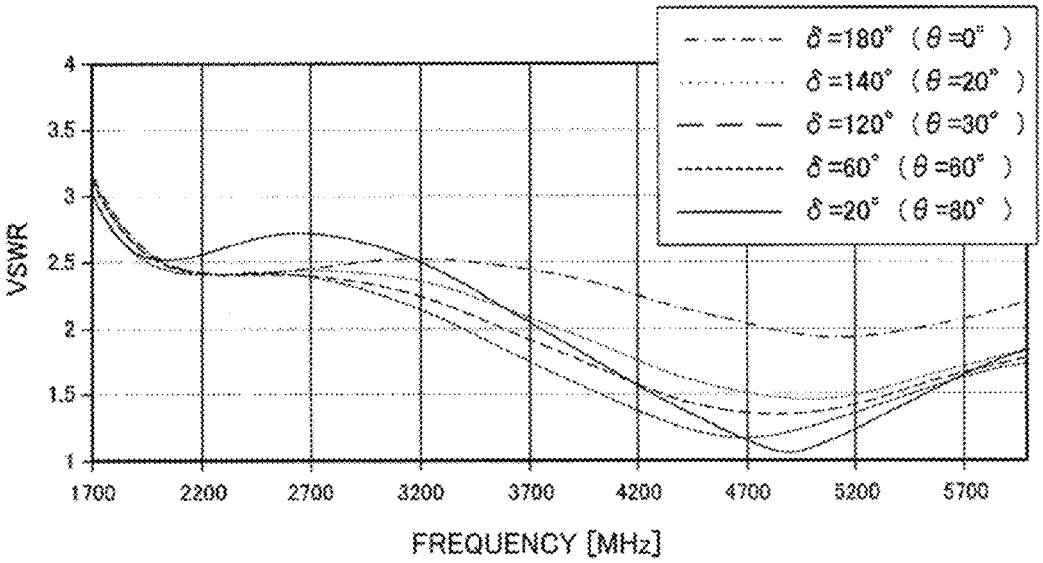
FIG. 19 is a graph illustrating VSWR characteristics of an antenna.

FIG. 19 is a view illustrating electrical characteristics of the antenna 100. FIG. 19 illustrates the VSWR (Voltage Standing Wave Ratio) of the antenna 100 at the time when the opening degree δ is set at 180 degrees, 140 degrees, 120 degrees, 60 degrees and 20 degrees (0 degree, 20 degrees, 30 degrees, 60 degrees and 80 degrees in terms of the folding angle θ). As is illustrated in FIG. 19, the antenna 100 does not have the fixed opening degree δ indicating the most excellent VSWR in the whole range of frequencies from 1.7 GHz to 6.0 GHz. However, it can be generally said that when the opening degree δ is 60 degrees to 140 degrees, better VSWR can be obtained in the whole range of frequencies of 1.7 GHz to 6.0 GHz compared to other opening degrees δ. In addition, in a range of frequencies between 4.7 GHz and 5.4 GHz, when the opening degree δ is 20 degrees, the most excellent VSWR characteristic is obtained. Accordingly, referring to the characteristics of FIG. 12 to FIG. 17 and FIG. 19, it becomes possible to optimize the balance among the gain, the range of the directionality, and the VSWR, by appropriately selecting the opening degree δ (folding angle θ) of the antenna 100 to be used.

In order that the antenna device for vehicle 1 is miniaturized and the antenna device for vehicle 1 accommodates a lot of antennas therein, it is desirable that the size of the antenna 100 is as small as possible, but a certain size is required in order that the antenna 100 obtains desired antenna characteristics. Then, in the antenna 100 of the present embodiment, the height of the radiating element 130 is set to be ⅛ or higher of a wavelength of the radio wave at a lower limit of the antenna band frequencies. The height of the radiating element 130 is defined in the following way. The height of the radiating element 130 is defined as a length of the radiating element 130 along a direction of the folding line of the folded portion 137 in the case where the radiating element 130 is projected onto the virtual symmetric plane A1 and viewed. The radiating element 130 has such a shape as to be folded at the folded portion 137. In the case of an antenna 100, in which the radiating element 130 is not folded and the opening degree δ is set at 180 degrees, has a shape illustrated in FIG. 2. At this time, when the radiating element 130 is projected onto the virtual symmetric plane A1 and viewed, the projected and viewed image becomes a folding line (center line indicated by alternate long and short dashed line in FIG. 2) that is the folded portion 137, and accordingly, the length along the direction of the folding line becomes the length of the folding line itself. Accordingly, as for the radiating element 130 of FIG. 2, the length of the folding line becomes the height of the radiating element 130.

In the case of the antenna 100 that is illustrated in FIG. 6, in which the opening degree δ is set at 60 degrees, when the radiating element 130 is projected onto the virtual symmetric plane A1 (see FIG. 2) and viewed, the projected and viewed image becomes an image having such a shape that an ellipse is divided into four equal parts by the long axis and the short axis. However, also in this case, the length of the folded portion 137 along the folding line becomes the length of the folding line. For this reason, the length of the folding line becomes the height of the radiating element 130.

In FIG. 2 and FIG. 6, the antenna 100 is installed in an uprightly standing state where the folding line of the folded portion 137 is orthogonal to the ground plate 110, but also in a case where the antenna 100 is installed in a standing state where the expansion direction is faced obliquely upward without being upright, the height of the radiating element 130 is defined in the same manner. In addition, also in the case where the radiating element 130 having the opening degree δ=180 degrees is not formed into the semi-elliptical shape (for example, a shape of FIG. 20 that will be described later), the height of the radiating element 130 is defined in the same manner. The height of the radiating element 130 is set at ⅛ or higher of the wavelength of the radio wave at a lower limit of the antenna band frequencies.

As described above, the antenna 100 of the present embodiment can increase the gain in the expansion direction. Accordingly, the directionality of the antenna 100 can be controlled by an orientation of the radiating element 130 that is arranged on the ground plate 110 (toward which orientation the expansion direction is arranged), and it is possible to realize a broadband antenna of which the gain in a desired direction is improved.

In addition, an antenna device 10 that includes a plurality of (for example, two) antennas 100 can increase the gains in the expansion directions by the respective antennas 100. Accordingly, by adjusting the number of antennas 100, each of the expansion directions thereof, and the opening degrees δ thereof so as to cover all azimuth directions, it is possible to realize an antenna device having a high gain and the non-directionality (or characteristics close to non-directionality) in a broad band.

In addition, each of the antennas 100 constituting the antenna device 10 is arranged at a position lower than the radio antenna 20 that is another antenna. In addition, the antenna band frequencies of the other antenna (in this case, the radio antenna 20) are lower than the antenna band frequencies (1 GHz or higher) of the antenna 100. Accordingly, it can be said that the antenna device 10 has a structure in which interference from another antenna (in this case, the radio antenna 20) with respect to the antenna 100 resists occurring.

The height of the radiating element 130 is ⅛ or higher of the wavelength. Accordingly, when the antenna band frequencies are 1 GHz or higher, the height can be particularly reduced, and the degree of freedom of arrangement in the antenna device for vehicle 1 increases.

One example of the embodiment has been described above. The mode to which the invention can be applied is not limited to the above embodiment; and addition, omission and modification of constituent elements can be appropriately made. For example, the invention can be applied to such examples of modification that the above embodiment is modified in the following ways.

First Example of Modifications

For example, in the above embodiment, the radiating element 130 has been exemplified that has a semi-elliptical shape in a state where the opening degree δ is 180 degrees, but the shape of the radiating element is not limited thereto, and can be an isosceles triangle shape or shapes in which those designs are appropriately changed. It should be noted that also in this case, the angle formed by the end portion and the first radiating element portion is an acute angle, and that the angle formed by the end portion and the second radiating element portion is an acute angle. In addition, the angle formed by the end portion and the first radiating element portion is substantially the same as the angle formed by the end portion and the second radiating element portion.

Figure 20:
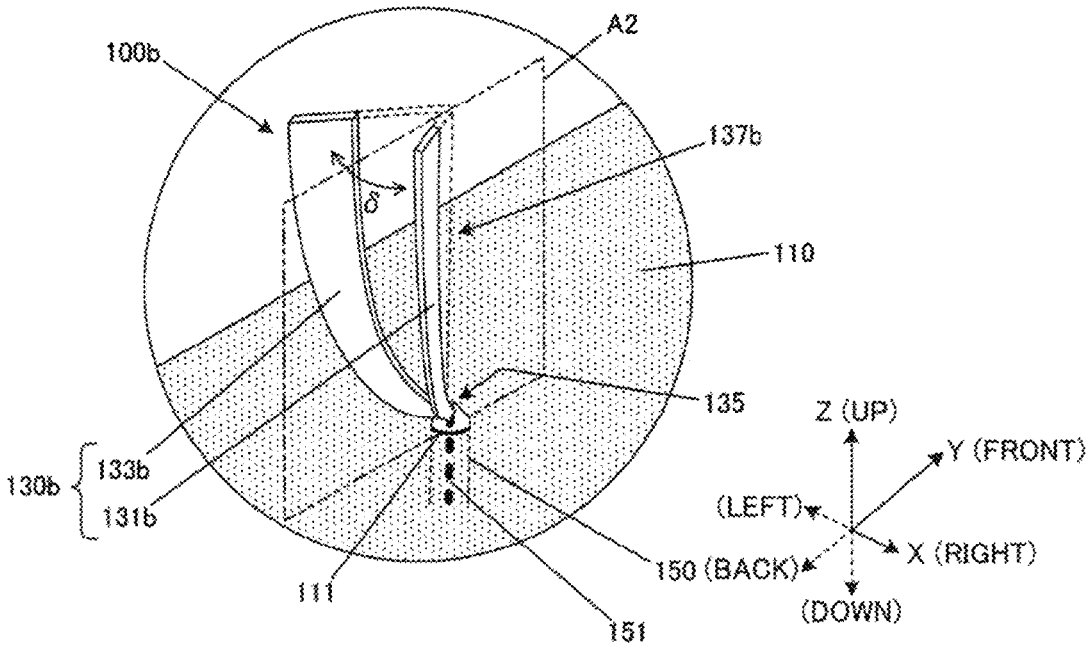
FIG. 20 is a view illustrating a structure example of an antenna in an example of modification.

In addition, the shape of the radiating element can also be such a shape as is illustrated in FIG. 20. FIG. 20 is a view illustrating a structure example of an antenna 100*b* in the present example of modification. As is illustrated in FIG. 20, the radiating element 130*b* constituting the antenna 100*b* of the present example of modification has a shape in which a part of the radiating element 130 illustrated in FIG. 6 is cut out. Specifically, the radiating element 130*b* has such a shape that in the radiating element 130 illustrated in FIG. 2 and FIG. 6, a central portion (a portion indicated by a broken line in FIG. 20) including the folded portion 137 is cut out.

In the above embodiment, as described with reference to FIG. 8 to FIG. 11, the expanded shapes of the first radiating element portion 131 and the second radiating element portion 133 have been the V shape (chevron shape) in which the first radiating element portion 131 and the second radiating element portion 133 are folded at the folded portion 137, in the top view. In the present example of modification as well, the schematic shape is substantially the same. The two radiating element portions (the first radiating element portion 131*b* and the second radiating element portion 133*b*) that the antenna 100*b* has are arranged in a V shape (chevron shape) starting from the end portion 135 as a base point, in a top view. Thereby, when the first radiating element portion 131*b* and the second radiating element portion 133*b* are viewed from above and are projected onto the end portion 135 side, the expanded shape becomes a V shape (chevron shape) starting from the end portion 135 as the base point. Note that similarly to the radiating element 130, the radiating element 130*b* forms an expanded shape of the radiating element 130*b* by the first radiating element portion 131*b* and the second radiating element portion 133*b* that are plane-symmetric to each other across the virtual symmetric plane A2.

In addition, in the radiating element 130*b*, a linear shape portion along the center line on the virtual symmetric plane A2 is defined as a virtual folded portion 137*b*. The virtual folded portion 137*b* is a portion of a linear shape at which respective portions obtained by extending the first radiating element portion 131*b* and the second radiating element portion 133*b* toward the virtual symmetric plane A2 side intersect with the virtual symmetric plane A2. In other words, the first radiating element portion 131*b* and the second radiating element portion 133*b* are integrally structured without including a part of the predetermined virtual folded portion 137*b* that is located on the virtual symmetric plane A2. Note that, in the radiating element 130*b*, an angle formed by the end portion 135 and the first radiating element portion 131*b* is an acute angle, and an angle formed by the end portion 135 and the second radiating element portion 133*b* is an acute angle. The end portion 135 is arranged on the ground plate 110. For this reason, the angle formed by the end portion 135 and the first radiating element portion 131*b* corresponds to an angle formed by an outer portion of the first radiating element portion 131*b* that extends from the end portion 135 and the ground plate 110. Similarly, the angle formed by the end portion 135 and the second radiating element portion 133*b* corresponds to an angle formed by an outer portion of the second radiating element portion 132*b* that extends from the end portion 135 and the ground plate 110. Note that the angle formed by the end portion 135 and the first radiating element portion 131*b* is substantially the same as the angle formed by the end portion 135 and the second radiating element portion 133*b*.

If the opening degree δ between the first radiating element portion 131*b* and the second radiating element portion 133*b* is set at 180 degrees as in the radiating element 100 of FIG. 2, and when the radiating element 130*b* is projected onto the virtual symmetric plane A2 and viewed, the projected and viewed image becomes a virtual folding line that is the virtual folded portion 137*b*. In addition, regarding the radiating element 130*b* of which the opening degree δ has been set at 180 degrees, the length of the radiating element 130*b* in a direction along the direction of the virtual folding line becomes a length of the virtual folding line itself. Accordingly, at an arbitrary opening degree δ, the length of the virtual folding line of the radiating element 130*b* becomes the height of the radiating element 130*b*. In addition, as for the antenna 100*b* according to the example of modification of the present embodiment, the height of the radiating element 130*b* is set at ⅛ or higher of a wavelength of the radio wave at the lower limit of the antenna band frequencies.

In the antenna 100*b* having a shape in which a part thereof is cut out in this way, when the frequency is increased, a difference in directionality for each opening degree δ (folding angle θ) appears similarly to the case illustrated in FIG. 12 to FIG. 17.

Figure 27:
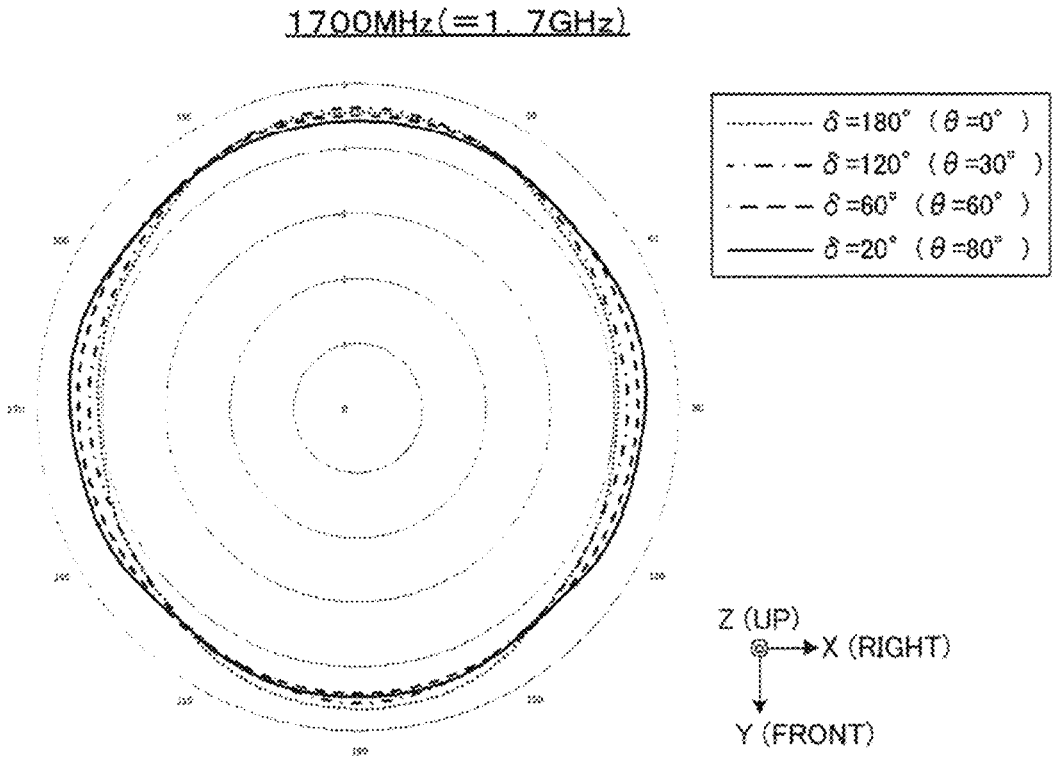
FIG. 27 is a view illustrating a directionality pattern at the time when the usable frequency is 1700 MHz.
Figure 28:
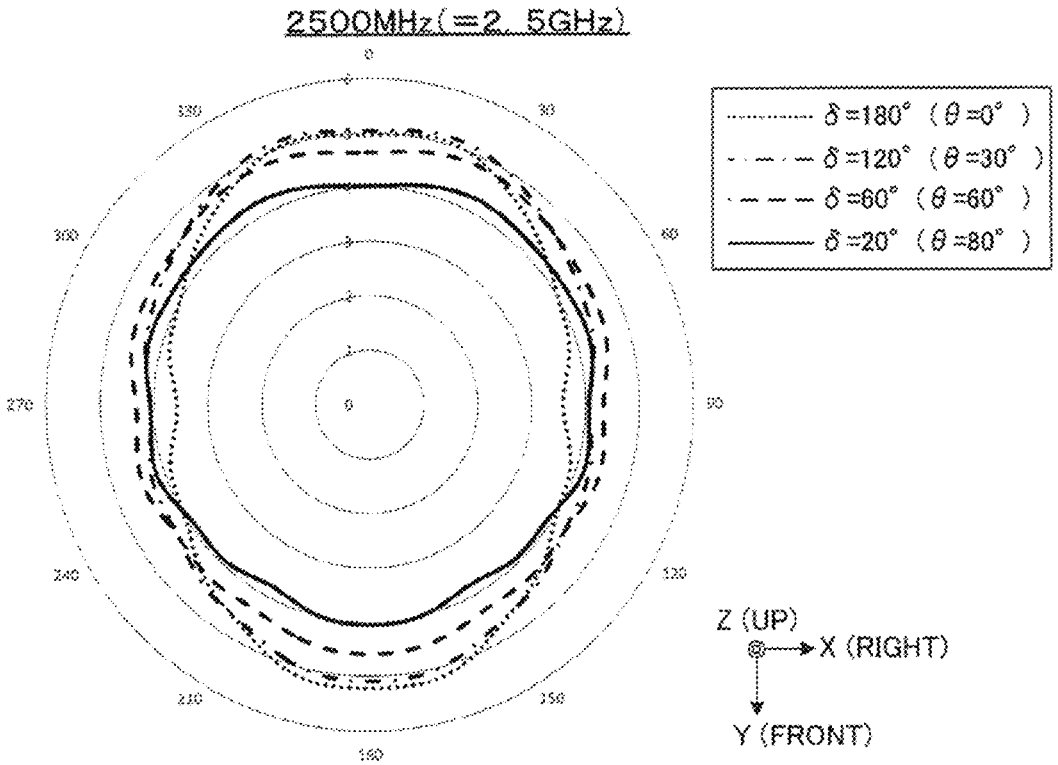
FIG. 28 is a view illustrating a directionality pattern at the time when the usable frequency is 2500 MHz.
Figure 29:
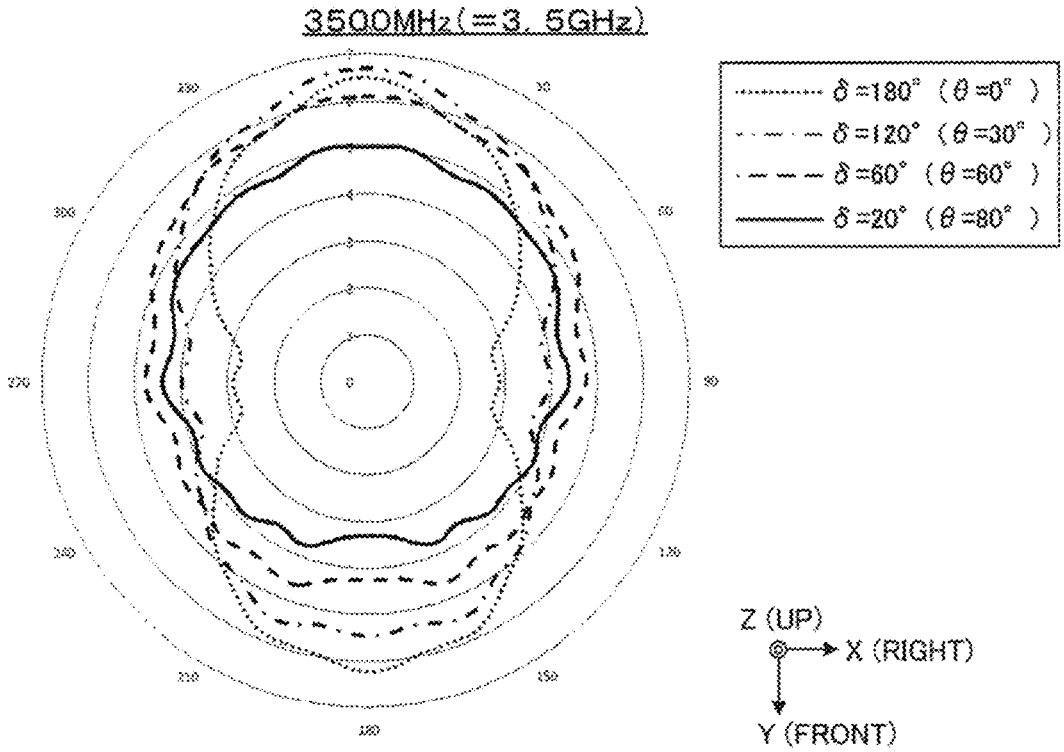
FIG. 29 is a view illustrating a directionality pattern at the time when the usable frequency is 3500 MHz.
Figure 30:
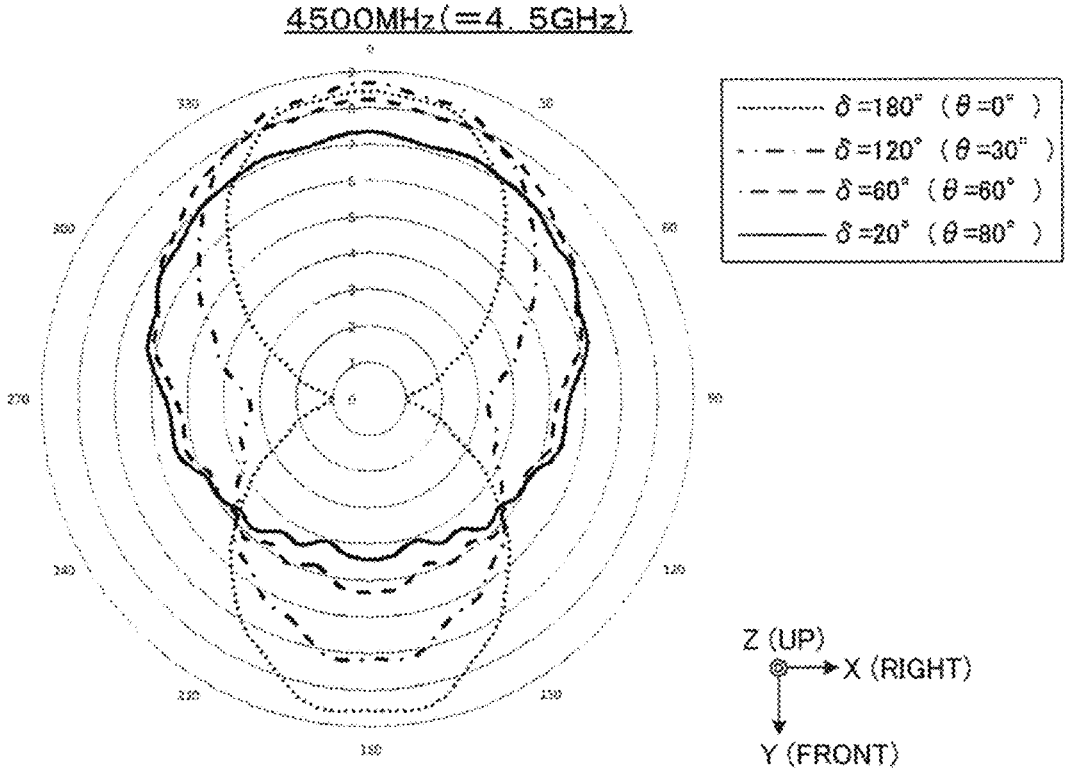
FIG. 30 is a view illustrating a directionality pattern at the time when the usable frequency is 4500 MHz.
Figure 31:
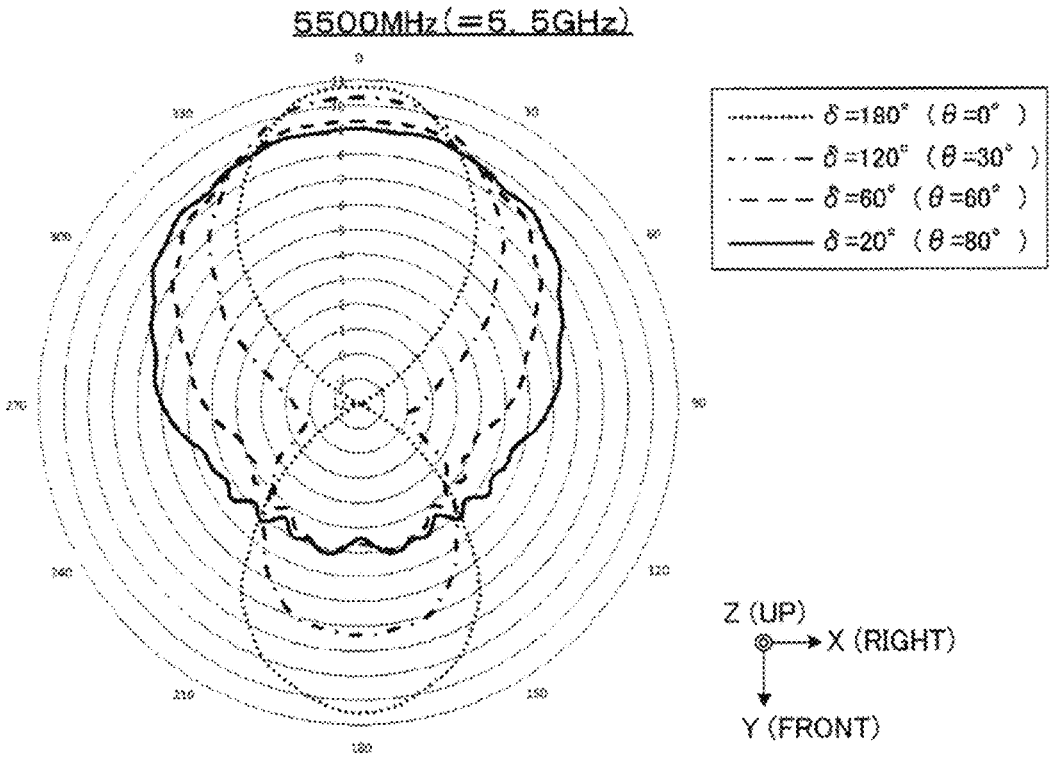
FIG. 31 is a view illustrating a directionality pattern at the time when the usable frequency is 5500 MHz.
Figure 32:
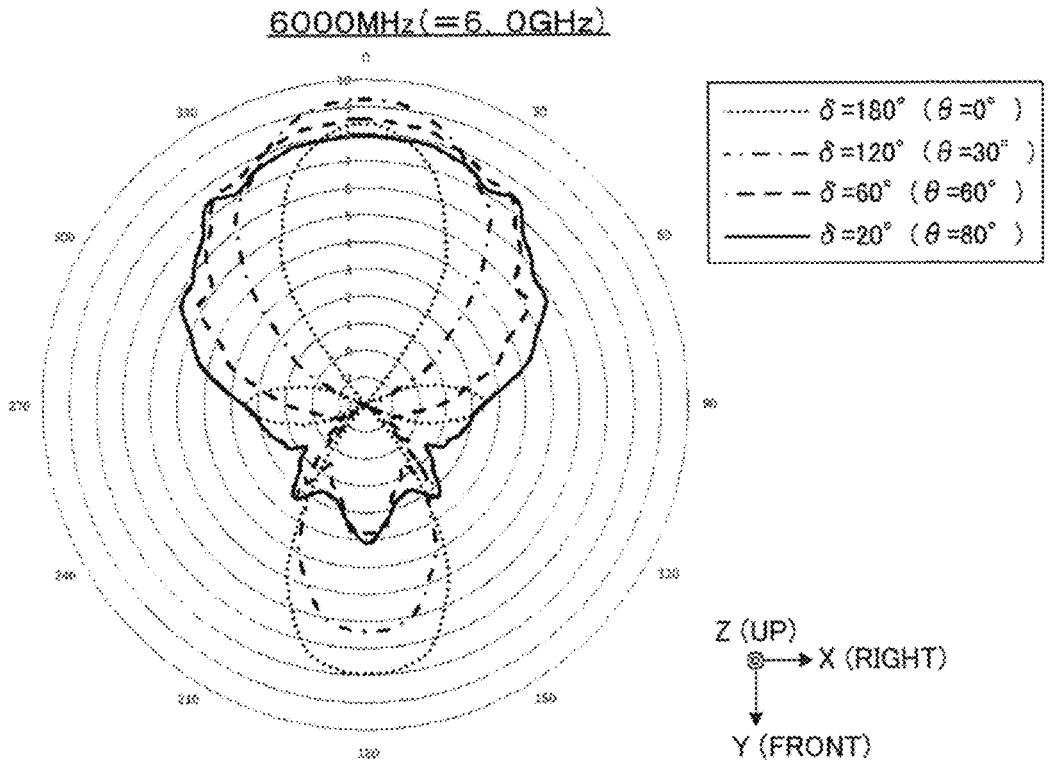
FIG. 32 is a view illustrating a directionality pattern at the time when the usable frequency is 6000 MHz.

More specifically, FIG. 27 illustrates a directionality pattern at the time when the usable frequency is set at 1700 MHz, FIG. 28 illustrates the directionality pattern at the time when the usable frequency is set at 2500 MHZ, FIG. 29 illustrates the directionality pattern at the time when the usable frequency is set at 3500 MHz, FIG. 30 illustrates the directionality pattern at the time when the usable frequency is set at 4500 MHz, FIG. 31 illustrates the directionality pattern at the time when the usable frequency is set at 5500 MHz, and FIG. 32 illustrates the directionality pattern at the time when the usable frequency is set at 6000 MHz, respectively.

For example, as is illustrated in FIG. 27, in a case where a usable frequency is 1700 MHz (=1.7 GHz), there is not a significant difference in the directionality of each azimuth direction, and even when the opening degree δ is changed from 180 degrees to 20 degrees (even when the folding angle θ is changed from 0 degrees to 80 degrees), there is not a significant difference in the directionality in the case of 1700 MHz. On the other hand, when the frequency is increased as are illustrated in FIG. 28 to FIG. 32, a difference appears in the directionality for each opening degree δ (folding angle θ). For example, in the 6000 MHz (=6.0 GHz) illustrated in FIG. 32, a difference in the directionality according to the opening degree δ (folding angle θ) remarkably appears. FIG. 27 to FIG. 32 are views illustrating the directionality patterns of the horizontal plane (XY plane), which have been acquired at the folding angles θ at different frequencies.

Figure 21:
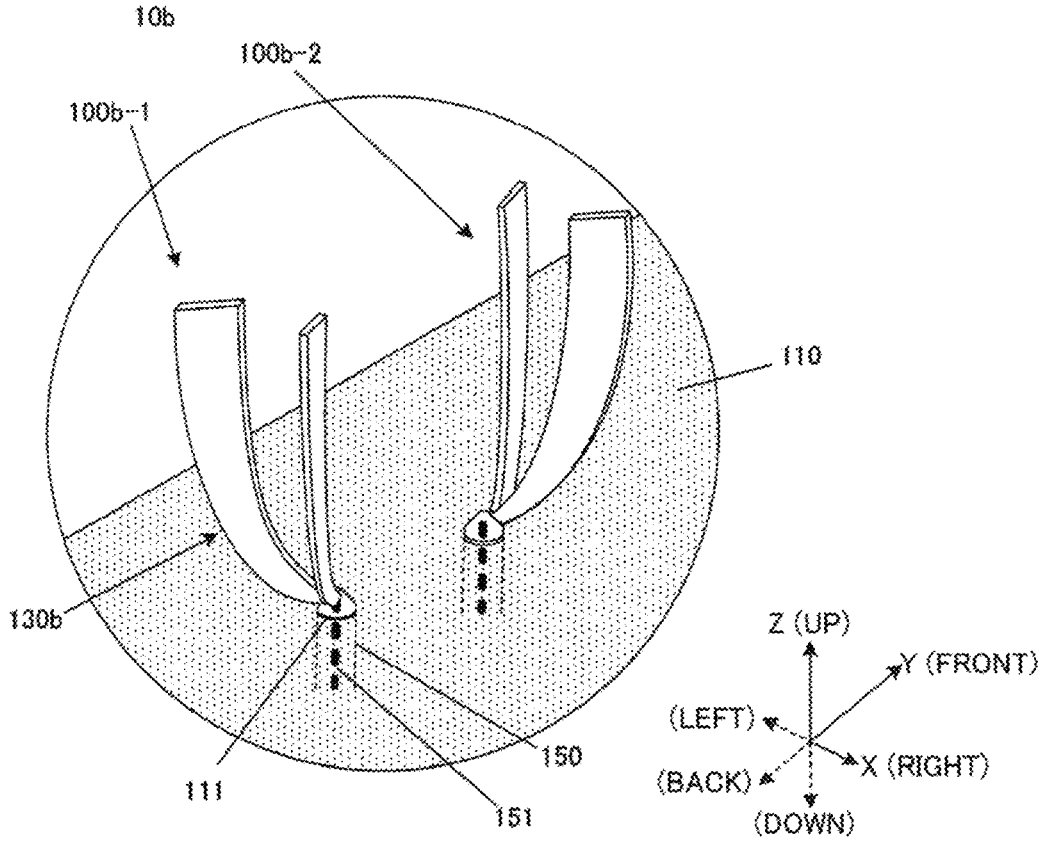
FIG. 21 is a view illustrating a structure example of an antenna device including a plurality of antennas in FIG. 20.

In addition, it is also possible to structure an antenna device including a plurality of antennas 100*b* in the present example of modification. For example, as illustrated in FIG. 21, an antenna device 10*b* in which two antennas 100*b*-1 and 100*b*-2 are arranged in common with the ground plate 110 can be configured. Specifically, the radiating elements 130*b* of the antennas 100*b*-1 and 100*b*-2 are arranged on the ground plate 110 so that the expansion directions thereof are different in the orientation from each other (in the example of FIG. 21, the forward and backward orientations are reverse to each other along the Y-axis direction). This antenna device 10*b* can reduce the correlation coefficient between the radiating elements 130*b*, while keeping the radiation efficiency of the radiating elements 130*b*. Accordingly, it becomes possible to further enhance the isolation between the radiating elements 130*b*.

The electrical characteristics of the antenna device 10*b* will be specifically described below with reference to FIG. 22 to FIG. 26. Note that, in FIG. 22 to FIG. 26, two antennas are arranged as in the antenna device 10*b* illustrated in FIG. 21. Specifically, in the antenna device 10*b*, the radiating elements 130*b* of the respective antennas of which the opening degrees of expansion are the same are arranged such that the expansion directions thereof are different in the orientation from each other (for example, forward and backward orientations are reverse to each other along the Y-axis direction). In FIG. 22 to FIG. 26, an antenna device in which two antennas are arranged that do not have the cutout is illustrated as a reference example. Specifically, in the antenna device of the reference example, as is illustrated in FIG. 6, the antenna elements that do not have the cutout are arranged such that the expansion directions are different in the orientation from each other (for example, the forward and backward orientations are reverse to each other along the Y-axis direction). Illustrated is the case of the opening degree of expansion of each antenna in the antenna device of the reference example being the same as the opening degree of expansion of each antenna in the antenna device 10*b*. In FIG. 22 to FIG. 26, the opening degree δ of expansion is set at 20 degrees (the folding angle θ is set at 80 degrees).

Figure 22:
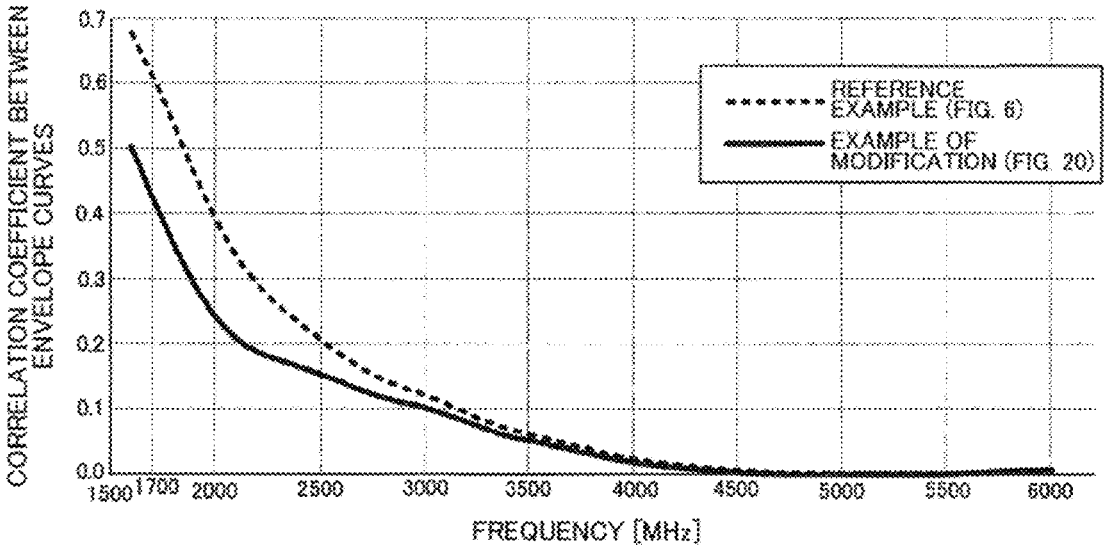
FIG. 22 is a graph illustrating correlation coefficients between envelope curves of two antennas.

FIG. 22 is a view illustrating correlation coefficients between envelope curves. The correlation coefficient between envelope curves indicates a degree of similarity of radiation patterns between two antennas. For this reason, the closer is the radiation pattern between the two antennas, the higher is the correlation coefficient between envelope curves. The correlation coefficient between envelope curves will be appropriately simply described below as a correlation coefficient. In the antenna device of the reference example, the correlation coefficient tends to increase from 4000 MHz (=4.0 GHz) to a low frequency band, and the correlation coefficient in 1700 MHz (=1.7 GHz) is about 0.6. This is assumed to originate in that in 1700 MHz as illustrated in FIG. 12, the directionality does not significantly change even when the opening degree δ of expansion is changed, and the radiation patterns are similar even when the two antennas are arranged such that the forward and backward orientations are reverse to each other. On the other hand, in the antenna device 10*b*, the correlation coefficient tends to increase from the 4000 MHz to the low frequency band, but the correlation coefficient in the 1700 MHz is about 0.4. In other words, the antenna device 10*b* can reduce the increase in the correlation coefficient compared to the antenna device of the reference example. In other words, in a frequency band in which the degree of change in directionality due to folding is small, a difference appears in the correlation coefficient depending on the presence or absence of the cutout.

Figure 23:
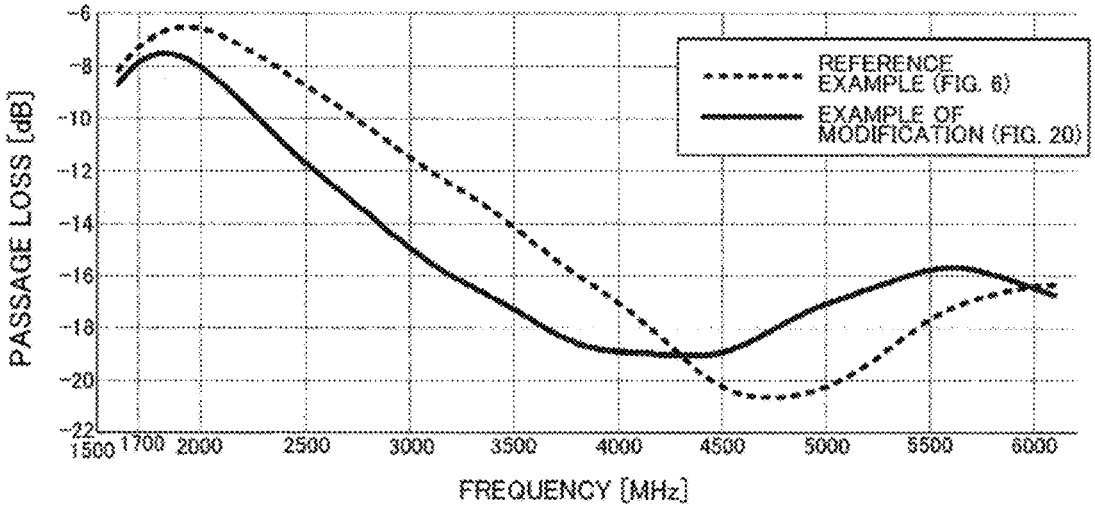
FIG. 23 is a graph illustrating passage loss characteristics between two antennas.

FIG. 23 is a view illustrating loss characteristics at the time when an electric power passes from a feeding point of one antenna to a feeding point of another antenna. As is illustrated in FIG. 23, in the antenna device of the reference example, it becomes possible to enhance the isolation between antennas in a wide frequency range. In addition, the antenna device 10*b* can further enhance the isolation in the frequency band of, for example, 4000 MHz or lower (=4.0 GHz or lower), compared to the antenna device of the reference example.

Figure 24:
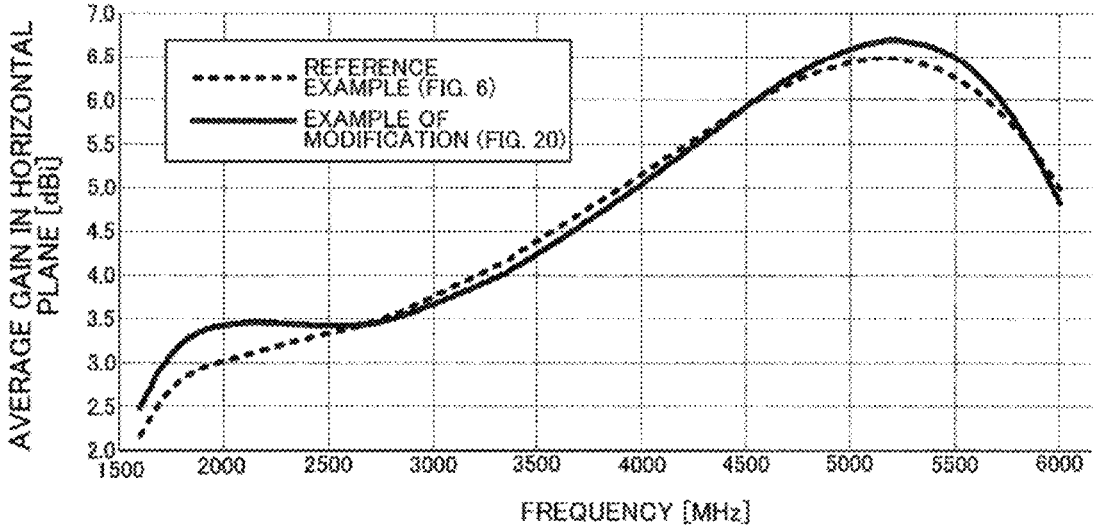
FIG. 24 is a graph illustrating an average gain in a horizontal plane.
Figure 25:
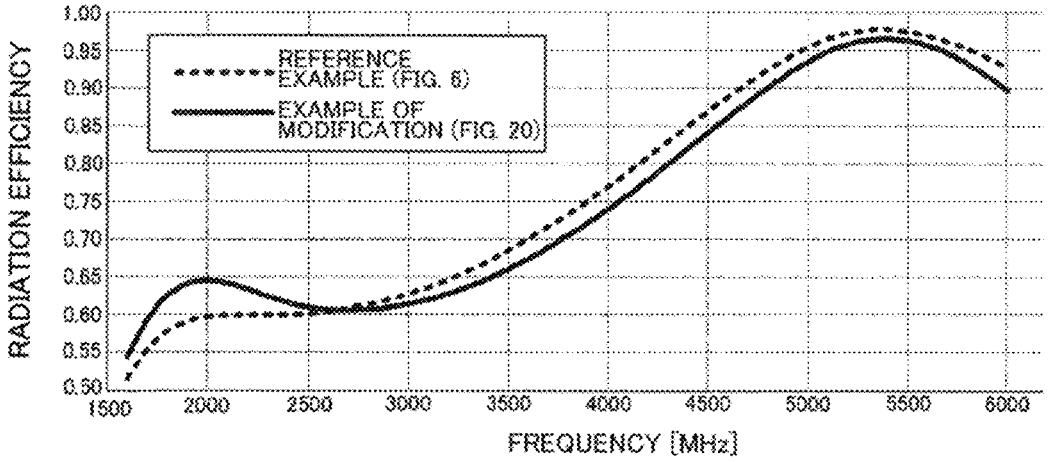
FIG. 25 is a graph illustrating a radiation efficiency.
Figure 26:
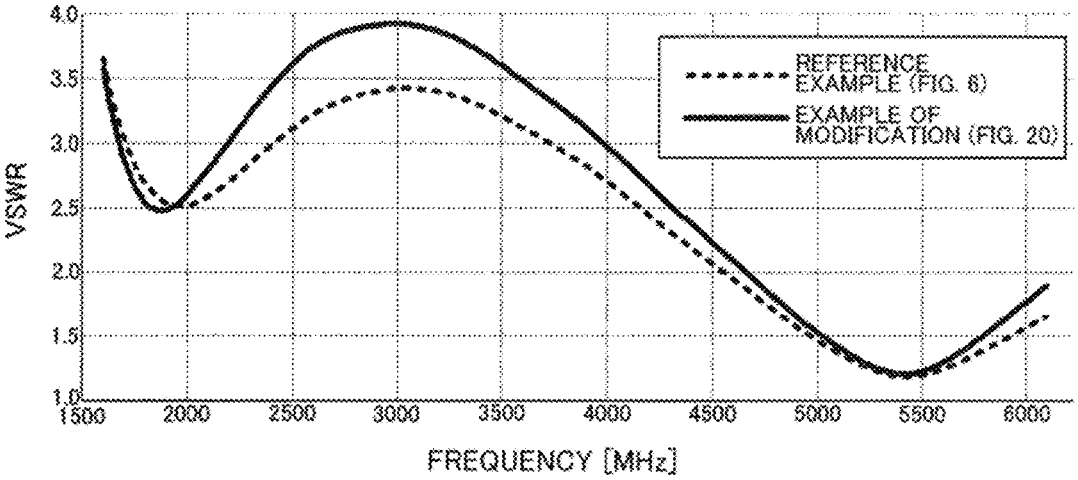
FIG. 26 is a graph illustrating VSWR characteristics.

Note that FIG. 24 is a view illustrating an average gain in a horizontal plane, FIG. 25 is a view illustrating a radiation efficiency, and FIG. 26 is a view illustrating VSWR characteristics. As is illustrated in FIG. 24 to FIG. 26, the antenna device 10*b* has the average gain in the horizontal plane, the radiation efficiency and the VSWR characteristics similar to those in the antenna device of the reference example. Specifically, in the case where antenna elements having the same opening degree of expansion in each antenna are arranged in different orientations of the expansion direction from each other, due to the antenna elements having a shape in which a part thereof is cut out, the antenna device 10*b* results in being capable of reducing the increase in the correlation coefficient between the envelope curves, and enhancing the isolation, substantially without changing the average gain in the horizontal plane, the radiation efficiency and the VSWR characteristics.

In addition, in the antenna device 10*b*, the two antennas 100*b*-1 and 100*b*-2 may not share a ground plate 110, and a ground plate may be disposed for each antenna. Similarly, in the structure of the above embodiment, the two antennas 100-1 and 100-2 in the antenna device 10 do not share the ground plate 110, but may be disposed on different ground plates (specifically, ground wiring of a substrate, a metallic base, a roof of a vehicle, or the like), respectively.

Other Examples of Modification

In addition, in the above embodiment, the antenna device 10 including two antennas 100 has been exemplified, but the number of antennas 100 constituting the antenna device 10 is not limited to two, and the antenna device 10 can also be structured so as to include three or more antennas 100. For example, the number of antennas 100 may be four, and expansion directions of the radiating elements 130 may be arranged so as to be faced toward four directions of forward, backward, leftward and rightward directions, respectively.

In addition, the opening degree δ of each of the plurality of antennas 100 included in the antenna device 10 does not need to be the same with each other, and the angles may be different. As for the height as well, the heights of the antennas 100 may be set at different heights by adjusting each of the heights, so as to improve the gain in a frequency band to be used or a plurality of frequency bands, because the higher is the height, the higher is the gain at a low frequency.

In addition, in the above embodiment, in the case where the plurality of antennas 100 are arranged, the radiating elements 130 are determined to be arranged such that the expansion directions are faced toward different directions. On the other hand, the radiating elements 130 may be arranged such that the expansion directions are faced toward the same direction. Thereby, it becomes possible to increase the gain in a direction in which the radiating element 130 faces. In addition, in this case, the opening degree δ of each of the radiating elements 130 may be changed.

In the antenna device for vehicle 1 in the above embodiment, the plurality of antennas 100 have been described so as to be arranged behind the radio antenna 20, as illustrated in FIG. 1, but the embodiment is not limited to the above embodiment. For example, in the antenna device for vehicle 1, the arrangement of the plurality of antennas 100 can be arbitrarily changed. For example, the plurality of antennas 100 may be arranged in front of the radio antenna 20. In addition, the plurality of antennas 100 may be arranged, in such a positional relationship, for example, interposing the radio antenna 20. For one example, the plurality of antennas 100 may be arranged in such a positional relationship interposing the radio antenna 20 from the front and rear directions, or may be arranged in such a positional relationship interposing the radio antenna 20 from the left and right directions.

In addition, when one or more antennas 100 are arranged in front of or behind the radio antenna 20 in the antenna device for vehicle 1, at least a part of region of the one or more antennas 100 may be arranged on a substantially center line between the front and rear directions of the capacitance loading element 23. In addition, when the plurality of antennas 100 are arranged in such a positional relationship interposing the radio antenna from the front and rear directions in the antenna device for vehicle 1, at least a part of region of the one or more antennas 100 may be arranged on a substantially center line between the front and rear directions of the capacitance loading element 23.

In addition, the height of the antenna 100 can be designed to be lower for operation in a higher frequency band. As a result, it becomes possible to enhance the degree of freedom in design of the antenna 100.

In addition, in the above embodiment, the antenna 100 has been described so as to be accommodated in the antenna case 11, but the antenna 100 may be accommodated in a housing other than the antenna case 11. In other words, the antenna 100 may be accommodated in a housing other than the antenna case 11 having the shark fin shape. In addition, in this case, the shape of the housing can be arbitrarily changed.

In addition, in the above embodiment, the antenna device for vehicle that is mounted on a vehicle has been exemplified, but the invention is not limited to the above embodiment. For example, the invention can also be similarly applied to an antenna device mounted on an aircraft, a ship or the like, to an antenna device that is used in a base station of wireless communication, and to the like.

EXPLANATION OF REFERENCES

1 antenna device for vehicle
11 antenna case
13 antenna base
10 antenna device
100 (100-1, 100-2) and 100*b* (100*b*-1, 100*b*-2) antenna
110 ground plate
130 and 130*b* radiating element
131 first radiating element portion
133 second radiating element portion
135 end portion
137 folded portion
151 feeding line (feeding portion)
20 radio antenna
30 satellite radio antenna
40 GNSS antenna
δ opening degree
θ folding angle

The invention claimed is:

1. An antenna device comprising:

at least two antennas, each of which includes:

a ground plate; and a radiating element standing against the ground plate, wherein the radiating element has an end portion, a first radiating element portion shaped planar and a second radiating element portion shaped planar, the first radiating element portion and the second radiating element portion being arranged in common with the end portion, wherein an axis of the radiating element is a line passing through the end portion and including a direction of standing of the radiating element, wherein when viewed from a direction of the axis, the first radiating element portion extends in a first direction from the axis, the second radiating element portion extends in a second direction from the axis different from the first direction, a shape formed by the first radiating element portion and the second radiating element portion is a V shape, and an angle formed by the first radiating element portion and the second radiating element portion is a predetermined angle having a directionality according to a predetermined direction, wherein the predetermined angle is an acute angle or an obtuse angle, and wherein each of the predetermined angles of the at least two antennas faces differently from each other and is a different angle from each other.

2. The antenna device according to claim 1, wherein the first radiating element portion and the second radiating element portion of each of the at least two antennas are integrally structured via the axis.

3. The antenna device according to claim 1, wherein at least a portion which is located on the axis is cut out in at least one of the first radiating element portion and the second radiating element portion of each of the at least two antennas, wherein the first radiating element portion and the second radiating element portion are configured to be separated from each other.

4. The antenna device according to claim 1, wherein the first radiating element portion and the second radiating element portion of each of the at least two antennas are plane-symmetric to each other across a predetermined plane including the axis.

5. The antenna device according to claim 1, wherein an angle formed by the ground plate and an outer portion of the first radiating element portion extended from the end portion is an acute angle, wherein an angle formed by the ground plate and an outer portion of the second radiating element portion extended from the end portion is an acute angle.

6. The antenna device according to claim 1, wherein the radiating element of each of the at least two antennas has a self-similar shape with respect to the end portion.

7. The antenna device according to claim 1, wherein the first radiating element portion of each of the at least two antennas has a position farthest from the end portion as an other end, wherein a length between the intersection of the perpendicular line from the other end to the axis and the axis in the first radiating element portion and the end portion is a length of ⅛ or longer of a wavelength of a radio wave at a lower limit of frequency to which the radiating element corresponds.

8. The antenna device according to claim 1, wherein a lower limit of frequency to which the radiating element of each of the at least two antennas corresponds is 1 GHz or higher.

9. The antenna device according to claim 1, wherein the predetermined angle is 20 degrees or larger and 160 degrees or smaller.

10. A composite antenna device for a vehicle comprising the antenna device according to claim 1, the composite antenna device including a first antenna corresponding to a frequency different from a frequency of the at least two antennas.

11. The composite antenna device according to claim 10, wherein the at least two antennas are arranged at positions behind the first antenna.

12. The composite antenna device according to claim 10, wherein the frequency of the first antenna is lower than the frequency of the at least two antennas.

13. The composite antenna device according to claim 10, wherein an overall height of the first antenna is higher than an overall height of the at least two antennas.

14. The composite antenna device according to claim 10, wherein the first antenna includes a capacitance loading element.

15. The composite antenna device according to claim 14, wherein upper ends of the at least two antennas are arranged below a lower end of the capacitance loading element of the first antenna.

16. The composite antenna device according to claim 14, at least a part of region of the at least two antennas is arranged on a substantially center line between a front and rear directions of the capacitance loading element.

17. The composite antenna device according to claim 10, further comprising a second antenna corresponding to frequency different from the frequencies of the first antenna and the at least two antennas, wherein the second antenna is arranged at a position in front of the first antenna.

* * * * *